US006987252B2

(12) United States Patent
Graves et al.

(10) Patent No.: US 6,987,252 B2
(45) Date of Patent: Jan. 17, 2006

(54) SPEEDCOOKING OVEN INCLUDING CONVECTION/BAKE MODE AND MICROWAVE HEATING

(75) Inventors: Todd Vincent Graves, Louisville, KY (US); Kevin Farrelly Nolan, Sheperdsville, KY (US); Brian Robert Goodrich, Louisville, KY (US)

(73) Assignee: General Electric Company, Schenectady, NY (US)

( * ) Notice: Subject to any disclaimer, the term of this patent is extended or adjusted under 35 U.S.C. 154(b) by 329 days.

(21) Appl. No.: 09/758,611

(22) Filed: Jan. 11, 2001

(65) Prior Publication Data

US 2003/0024925 A1 Feb. 6, 2003

(51) Int. Cl.
*H05B 6/68* (2006.01)

(52) U.S. Cl. ..... 219/681; 219/685; 219/702; 219/710; 219/400; 126/21 A

(58) Field of Classification Search ..... 219/681, 219/685, 702, 710, 757, 400; 126/21 A
See application file for complete search history.

(56) References Cited

U.S. PATENT DOCUMENTS

| | | | | |
|---|---|---|---|---|
| 3,320,396 A | | 5/1967 | Boehm | |
| 3,569,656 A | * | 3/1971 | White | 219/685 |
| 3,716,687 A | * | 2/1973 | Constable | 219/681 |
| 4,262,183 A | | 4/1981 | Smith et al. | |
| 4,332,992 A | * | 6/1982 | Larsen et al. | 219/681 |
| 4,463,238 A | * | 7/1984 | Tanabe | 219/685 |
| 4,477,706 A | | 10/1984 | Mittelsteadt | |
| 4,481,396 A | | 11/1984 | Matsubayashi et al. | |
| 4,661,670 A | | 4/1987 | Eke | |
| 4,745,246 A | | 5/1988 | Hori et al. | |
| 4,771,154 A | | 9/1988 | Bell et al. | |
| 4,831,225 A | | 5/1989 | Ishifuro et al. | |
| 5,204,503 A | | 4/1993 | Maiellano, Jr. et al. | |
| 5,676,044 A | | 10/1997 | Lara, Jr. | |
| 5,676,870 A | | 10/1997 | Wassman et al. | |
| 5,712,464 A | | 1/1998 | Westerberg | |
| 5,726,423 A | | 3/1998 | Westerberg et al. | |
| 5,783,807 A | | 7/1998 | Uehashi et al. | |
| 5,786,569 A | | 7/1998 | Westerberg | |
| 5,814,794 A | | 9/1998 | Lim | |
| 5,883,362 A | | 3/1999 | Pettibone et al. | |
| 6,005,229 A | | 12/1999 | Brown et al. | |
| 6,005,235 A | * | 12/1999 | Shin | 219/757 |
| 6,060,701 A | * | 5/2000 | McKee et al. | 219/681 |
| RE36,724 E | | 6/2000 | Westerberg et al. | |

FOREIGN PATENT DOCUMENTS

| | | | |
|---|---|---|---|
| EP | 0977466 A2 | | 2/2000 |
| EP | 0977466 A3 | | 3/2000 |
| JP | 2-301988 | * | 12/1990 |
| JP | 10-125459 | | 5/1998 |

OTHER PUBLICATIONS

International Search Report, dated Oct. 14, 2002, Application No. PCT/US02/02209, 8pgs.
Patent Abstracts of Japan, vol. 1998, No. 10, Aug. 31, 1998, 2 pgs.

* cited by examiner

*Primary Examiner*—Philip H. Leung
(74) *Attorney, Agent, or Firm*—H. Naft Houser, Esq.; Armstrong Teasdale LLP

(57) ABSTRACT

The present invention relates to an oven that includes radiant cooking elements, a microwave cooking element, as well as convection cooking heating elements. The cooking elements are controlled to provide reduced cooking time as compared to known radiant ovens, yet a wide variety of foods can be cooked in the oven. The oven is operable in a speedcooking mode wherein both radiant and microwave cooking elements are utilized, a microwave only cooking mode wherein only the magnetron is utilized, and a convection/bake mode wherein radiant and convection cooking elements are utilized.

23 Claims, 23 Drawing Sheets

| | TCT | |
|---|---|---|
| TM (initial cavity T) | Min | Sec |
| 150 | 2 | 7 |
| 175 | 2 | 33 |
| 200 | 3 | 0 |
| 225 | 3 | 27 |
| 250 | 3 | 53 |
| 275 | 4 | 20 |
| 300 | 4 | 47 |
| 325 | 5 | 13 |
| 350 | 5 | 40 |
| 375 | 6 | 7 |
| 400 | 6 | 33 |
| 425 | 7 | 0 |
| 450 | 7 | 27 |

PHASE 1 (Compensated) Algorithms

| USER INPUT | | OUTPUT | | |
|---|---|---|---|---|
| *U* | *L* | U* | L | MW |
| *H* | *H* | 11 | 0 | 0 |
| | *L* | 11 | 0 | 0 |
| *MH* | *H* | 11 | 0 | 0 |
| | *L* | 11 | 0 | 0 |
| *M* | *H* | 9 | 0 | 4 |
| | *L* | 9 | 0 | 4 |
| *ML* | *H* | 9 | 0 | 6 |
| | *L* | 7 | 0 | 10 |
| *L* | *H* | 6 | 0 | 14 |
| | *L* | 3 | 0 | 22 |

FIG. 24

PHASE 2 (Normal) Algorithms

| USER INPUT | | OUTPUT | | |
|---|---|---|---|---|
| *U* | *L* | U | L | MW |
| *H* | *H* | 32 | 32 | 0 |
| | *L* | 32 | 25 | 0 |
| *MH* | *H* | 32 | 22 | 0 |
| | *L* | 32 | 20 | 0 |
| *M* | *H* | 28 | 28 | 4 |
| | *L* | 28 | 20 | 4 |
| *ML* | *H* | 26 | 22 | 6 |
| | *L* | 22 | 22 | 10 |
| *L* | *H* | 18 | 18 | 14 |
| | *L* | 10 | 10 | 22 |

FIG. 25

SPEEDCOOKING OVEN INCLUDING CONVECTION/BAKE MODE AND MICROWAVE HEATING

BACKGROUND OF THE INVENTION

This invention relates generally to ovens and, more particularly, to an oven operable in speedcooking, microwave, and convection/bake modes.

Ovens typically are either, for example, microwave, radiant, or thermal/convection cooking type ovens. For example, a microwave oven includes a magnetron for generating RF energy used to cook food in an oven cooking cavity. Although microwave ovens cook food more quickly than radiant or thermal/convection ovens, microwave ovens do not brown the food. Microwave ovens therefore typically are not used to cook as wide a variety of foods as radiant or thermal/convection ovens.

Radiant cooking ovens include an energy source such as lamps which generate light energy used to cook the food. Radiant ovens brown the food and generally can be used to cook a wider variety of foods than microwave ovens. Radiant ovens, however, cook many foods slower than microwave ovens.

In thermal/convection ovens, the food is cooked by the air in the cooking cavity, which is heated by a heat source. Standard thermal ovens do not have a fan to circulate the hot air in the cooking cavity. Convection ovens use the same heat source as a standard thermal oven, but add a fan to increase cooking efficiency by circulating the hot air around the food. Thermal/convection ovens cook the widest variety of foods. Such ovens, however, do not cook as fast as radiant or microwave ovens.

One way to achieve speedcooking in an oven is to include both microwave and radiant energy sources. The combination of microwave and radiant energy sources facilitates fast cooking of foods. In addition, and as compared to microwave only cooking, a combination of microwave and radiant energy sources can cook a wider variety of foods.

While speedcooking ovens are versatile and cook food quickly, in at least one known speedcooking oven, the radiant energy sources are thermally separated from the cooking cavity. Waste heat from the radiant energy sources is directed out of the oven via air flow paths. In addition, such known speedcooking oven is rated for operation at 240 volts. The 240 volt rating is required in order to simultaneously operate the radiant and microwave energy sources.

BRIEF SUMMARY OF THE INVENTION

In an exemplary embodiment of the invention, an oven includes radiant cooking elements, an RF energy source (e.g., a magnetron), and convection cooking elements. The oven is operable in a speedcooking mode wherein both radiant and microwave cooking elements are utilized, in a convection/bake bode in which convection and radiant cooking elements are utilized, and in a microwave only cooking mode wherein only the magnetron is utilized for cooking.

In an exemplary embodiment, the oven includes a shell, and a cooking cavity is located within the shell. The oven also includes a microwave module, an upper heater module, and a lower heater module. The microwave module includes a magnetron located on a side of cavity. The upper heater module includes radiant heating elements such as a ceramic heater and a halogen cooking lamp. The upper heater module also includes a sheath heater. A convection fan is provided for blowing air over the heaters and into the cooking cavity. The lower heater module includes at least one radiant heating element such as a ceramic heater.

Generally, a combination of the lamps, the heaters, and the RF generation system is selected to provide the desired cooking characteristics for speedcooking, microwave, and convection/bake modes. For example, in the speedcook mode, the radiant heaters and the convection fan are used to heat the outside of the food, and microwave energy is used to heat the inside of the food. As described below in more detail, the radiant heaters and the magnetron may be cycled throughout the cooking cycle to provide the desired cooking results.

In the convection/bake mode, the lower ceramic heater and upper sheath heater are energized to preheat the air in the oven. During the cooking cycle, the lower ceramic heater and upper sheath heater are controlled to provide the desired energy, and the convection fan circulates air to assure even cooking. In the microwave mode, the magnetron is energized in accordance with the user selections.

BRIEF DESCRIPTION OF THE DRAWINGS

FIG. 22 is a flow chart illustrating process steps for thermal compensation in the speedcook mode;

FIGS. 23, 24 and 25 illustrate lookup tables utilized in connection with the thermal compensation illustrated in FIG. 22;

DETAILED DESCRIPTION OF THE INVENTION

The present invention is directed, in one aspect, to operation of an oven that includes sources of radiant and microwave energy as well as at least one convection/bake heating element. Although one specific embodiment of such an oven is described below, it should be understood that the present invention can be utilized in combination with many other such ovens and is not limited to practice with the oven described herein. For example, the oven described below is an over the range type oven. The present invention, however, is not limited to practice with just over the range type ovens and can be used with many other types of ovens such as countertop or built-in wall ovens.

Figure 1:
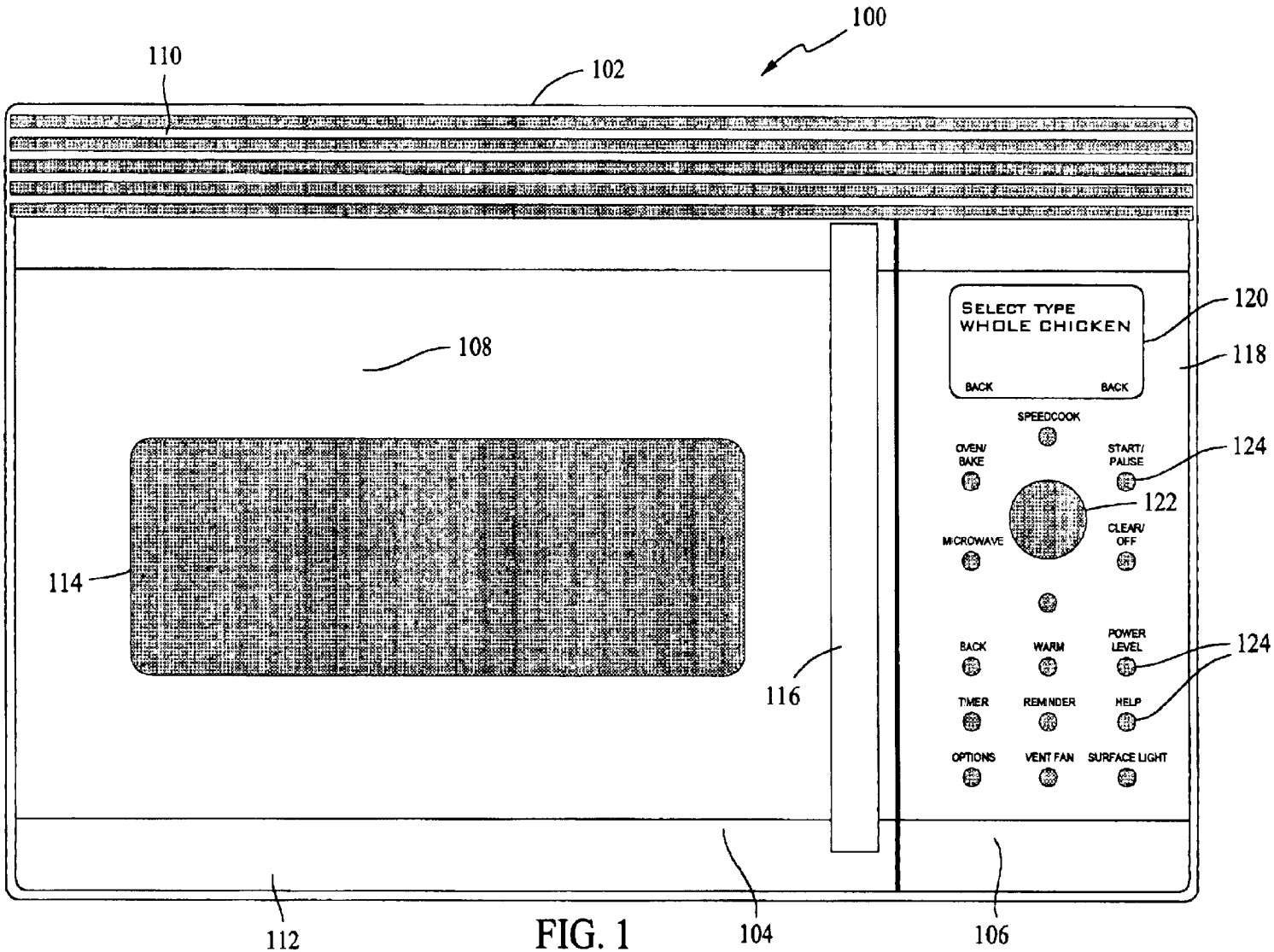
FIG. 1 is a front view of an oven.

FIG. 1 is a front view of an over the range type oven 100 in accordance with one embodiment of the present invention. Oven 100 includes an outer case 102, a plastic door frame 104, and a control panel frame 106. Oven 100 further includes a stainless steel door 108 mounted within door frame 104, an injection molded grille 110, and a bottom panel 112. A window 114 in door 108 is provided for viewing food in the oven cooking cavity, and an injection molded plastic handle 116 is secured to door 108. A control panel 118 is mounted within control panel frame 106.

Control panel 118 includes a display 120, an injection molded knob or dial 122, and tactile control buttons 124. Selections are made by rotating dial 122 clockwise or counter-clockwise and when the desired selection is displayed, pressing dial 122. For example, many cooking algorithms can be preprogrammed in the oven memory for many different types of foods. When a user is cooking a particular food item for which there is a preprogrammed cooking algorithm, the preprogrammed cooking algorithm is selected by rotating dial 122 until the selected food name is displayed and then pressing the dial. Instructions and selections are displayed on vacuum fluorescent display 120. The following functions can be selected from respective key pads 124 of panel.

| | |
|---|---|
| SPEEDCOOK | Selecting this pad enables an operator to perform the following speedcook functions: 1) manually enter speed cooking time and powerlevels, 2) select preprogrammed control algorithms, or 3) store manually programmed algorithms as recipes |
| OVEN/BAKE | Selecting this pad enables an operator to manually enter cooking time and temperature for the oven/bake mode. |
| MICROWAVE | Selecting this pad enables an operator to manually enter cooking time and power level for the microwave mode, as well as use preprogrammed microwave features, such as sensor cooking. |

-continued

| | |
|---|---|
| START/PAUSE | Selecting this pad enables an operator to start or pause cooking. |
| CLEAR/OFF | Selecting this pad stops all cooking and erases the current program. |
| MICROWAVE EXPRESS | Selecting this pad enables an instant 30 seconds of full-power microwave for quick and easy warming of a sandwich, or reheat of coffee. |
| BACK | Selecting this pad causes the oven to return to the previous selection. |
| WARM | Selecting this pad causes the oven to enter the warming and reheating mode. |
| POWER LEVEL | Selecting this pad enables adjusting the power levels for speed cooking and microwave cooking. |
| TIMER | Selecting this pad controls a general purpose timer (e.g., minutes and seconds) |
| REMINDER | Selecting this pad enables an operator to select a time at which an alarm is to sound. |
| HELP | Selecting this pad enables an operator to find out more about the oven and its features. |
| OPTIONS | Selecting this pad enables access to the auto night light, beeper volume control, clock, clock display, and display scroll speed features. |
| VENT FAN | Selecting this pad enables an operator to clear the cooktop area of smoke or steam. |
| SURFACE LIGHT | Selecting this pad turns ON/OFF the surface light for the cooktop. |

Figure 2:
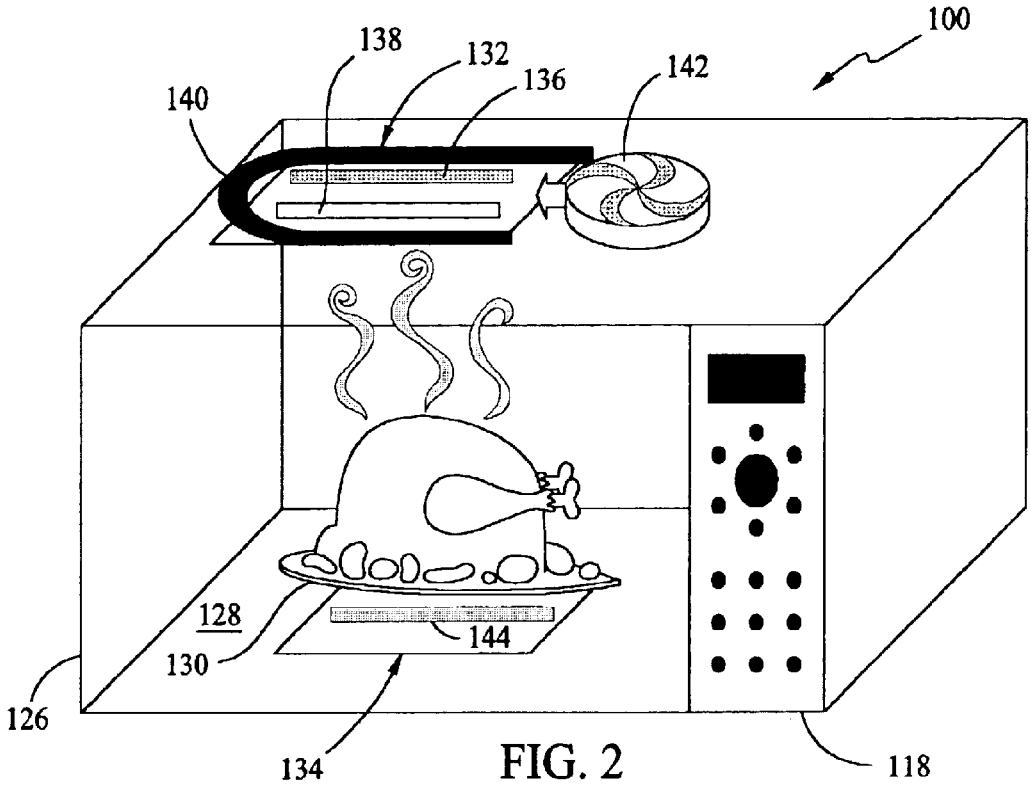
FIG. 2 is a schematic illustration of the oven shown in FIG. 1.

FIG. 2 is a schematic illustration of oven 100 shown in FIG. 1. As shown in FIG. 2, and in an exemplary embodiment, oven 100 includes a shell 126, and a cooking cavity 128 is located within shell 126. Cooking cavity 128 is constructed using high reflectivity (e.g., 72% reflectivity) stainless steel, and a turntable 130 is located in cavity 128 for locating food. Oven 100 includes a microwave module, an upper heater module 132, and a lower heater module 134. Microwave module includes a magnetron located on a side of cavity. Magnetron, in an exemplary embodiment, delivers a nominal 900 W into cavity according to standard IEC (International Electrotechnical Commission) procedure. Upper heater module 132 includes radiant heating elements illustratively embodied as a ceramic heater 136 and a halogen cooking lamp 138. In the exemplary embodiment, ceramic heater 136 is rated at 600 W and halogen cooking lamp 138 is rated at 500 W. Upper heater module 132 also includes a sheath heater 140. In the exemplary embodiment, sheath heater 140 is rated at 1100 W. A convection fan 142 is provided for blowing air over heating elements and into cooking cavity 128. Lower heater module 134 includes at least one radiant heating element illustrated as a ceramic heater 144 rated at 375 W.

The specific heating elements and RF generation system (e.g., a magnetron) can vary from embodiment to embodiment, and the elements and system described above are exemplary only. For example, the upper heater module can include any combination of heaters including combinations of halogen lamps, ceramic lamps, and/or sheath heaters. Similarly, lower heater module can include any combination of heaters including combinations of halogen lamps, ceramic lamps, and/or sheath heaters. In addition, the heaters can all be one type of heater. The specific ratings and number of lamps and/or heaters utilized in the upper and lower modules can vary from embodiment to embodiment. Generally, the combinations of lamps, heaters, and RF generation system is selected to provide the desired cooking characteristics for speedcooking, microwave, and convection/bake modes.

Figure 3:
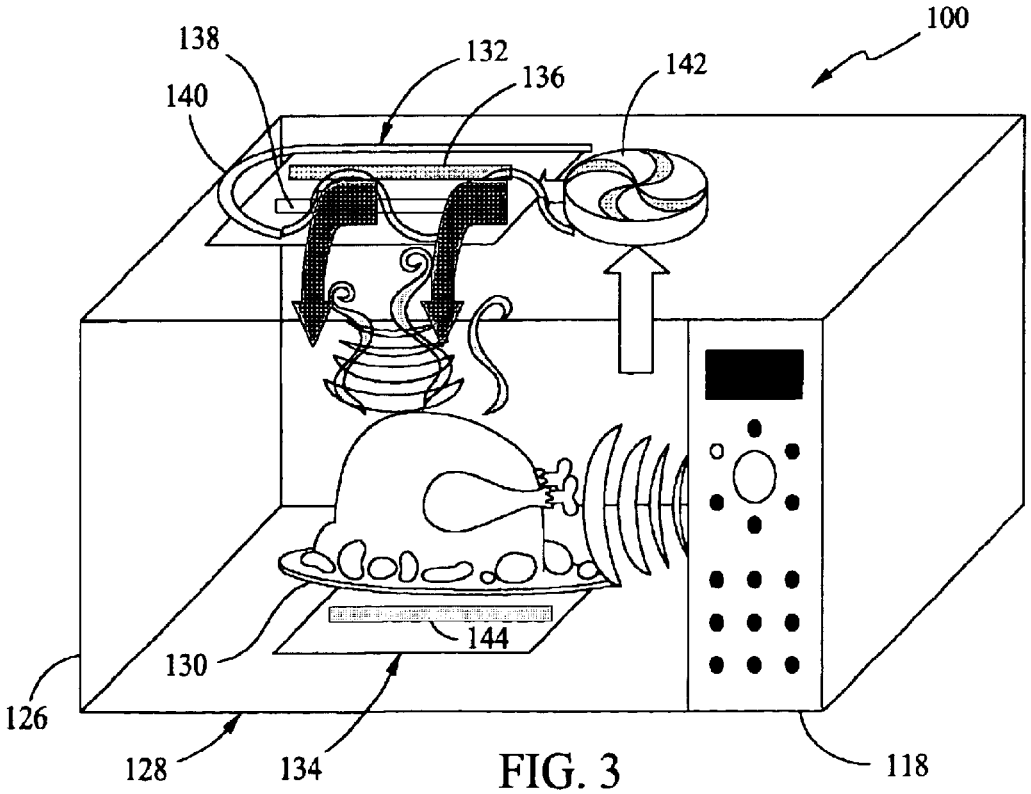
FIG. 3 is a schematic illustration of the oven shown in FIG. 1 in speedcooking mode.
Figure 4:
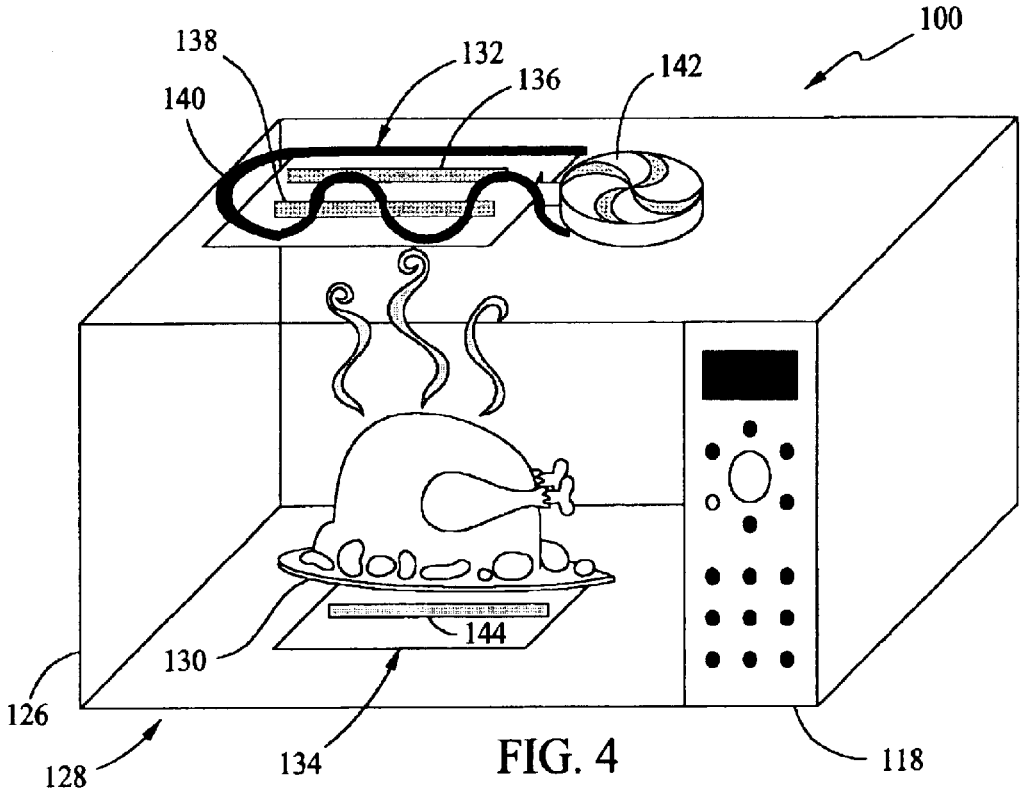
FIG. 4 is a schematic illustration of the oven shown in FIG. 1 in convection/bake mode.
Figure 5:
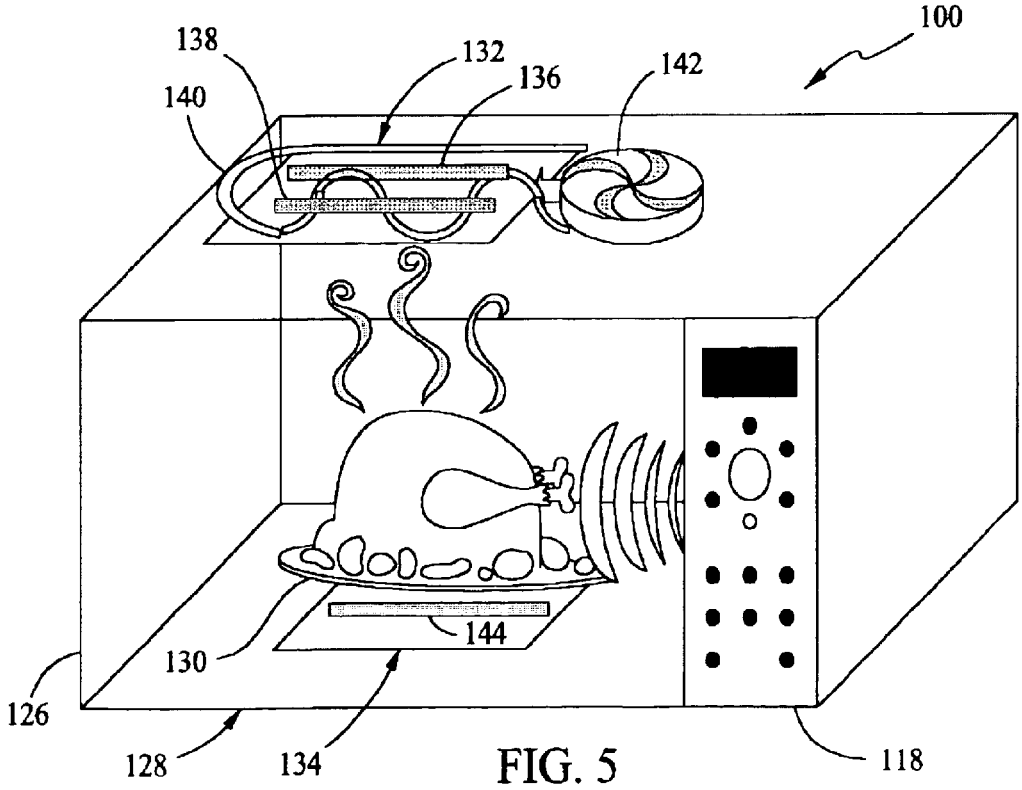
FIG. 5 is a schematic illustration of the oven shown in FIG. 1 in microwave mode.

FIGS. 3, 4, and 5 schematically illustrate operation of oven 100 in various modes. Oven 100 may, of course, operate in fewer or more modes than as illustrated in FIGS. 3, 4, and 5, and the descriptions set forth below are exemplary only. In addition, operation and use of oven 100 is not limited to the specific order of steps described below. Various steps can be performed in orders different from the exemplary order described below.

FIG. 3 is a schematic illustration of oven 100 in speedcooking mode. Generally, for the speedcook mode, a user places food in cavity on turntable 130 and selects "Speedcook" from control panel 118. The user then uses dial 122 to select a food type and then selects "Start". Radiant heaters 136 and 138 and convection fan 142 are used to heat the outside of the food, and microwave energy is used to heat the inside of the food. As described below in more detail, the radiant heaters and the magnetron are preferably cycled throughout the cooking cycle to provide the desired cooking results.

FIG. 4 is a schematic illustration of oven 100 in a convection/bake mode. Generally, for the convection/bake mode, a user selects "Convection/Bake" from keypad 118, and then uses dial 122 to select a temperature and cook time. Lower ceramic heater 144 and upper sheath heater 140 are then energized to preheat the air in oven. The food is then placed in cavity 128 and cooking begins. During the cooking cycle, convection fan 142 circulates air to assure even cooking.

FIG. 5 is a schematic illustration of oven 100 in a microwave mode, sometimes referred to herein as the microwave only mode. Generally, for the microwave mode, the user places food in oven on turntable 130. The user then selects "Microwave" or "Express" from keypad 118. Dial 122 is utilized to select a food type and once the food type is selected, the user selects "Start" from keypad 118. The magnetron is then energized in accordance with the user selections.

Set forth below is a description of one specific embodiment of an oven 200 that is operable in speedcooking, convection/bake, and microwave modes. Many variations of such specific embodiment are possible, and the present invention is not limited to the specific embodiment described below.

Figure 6:
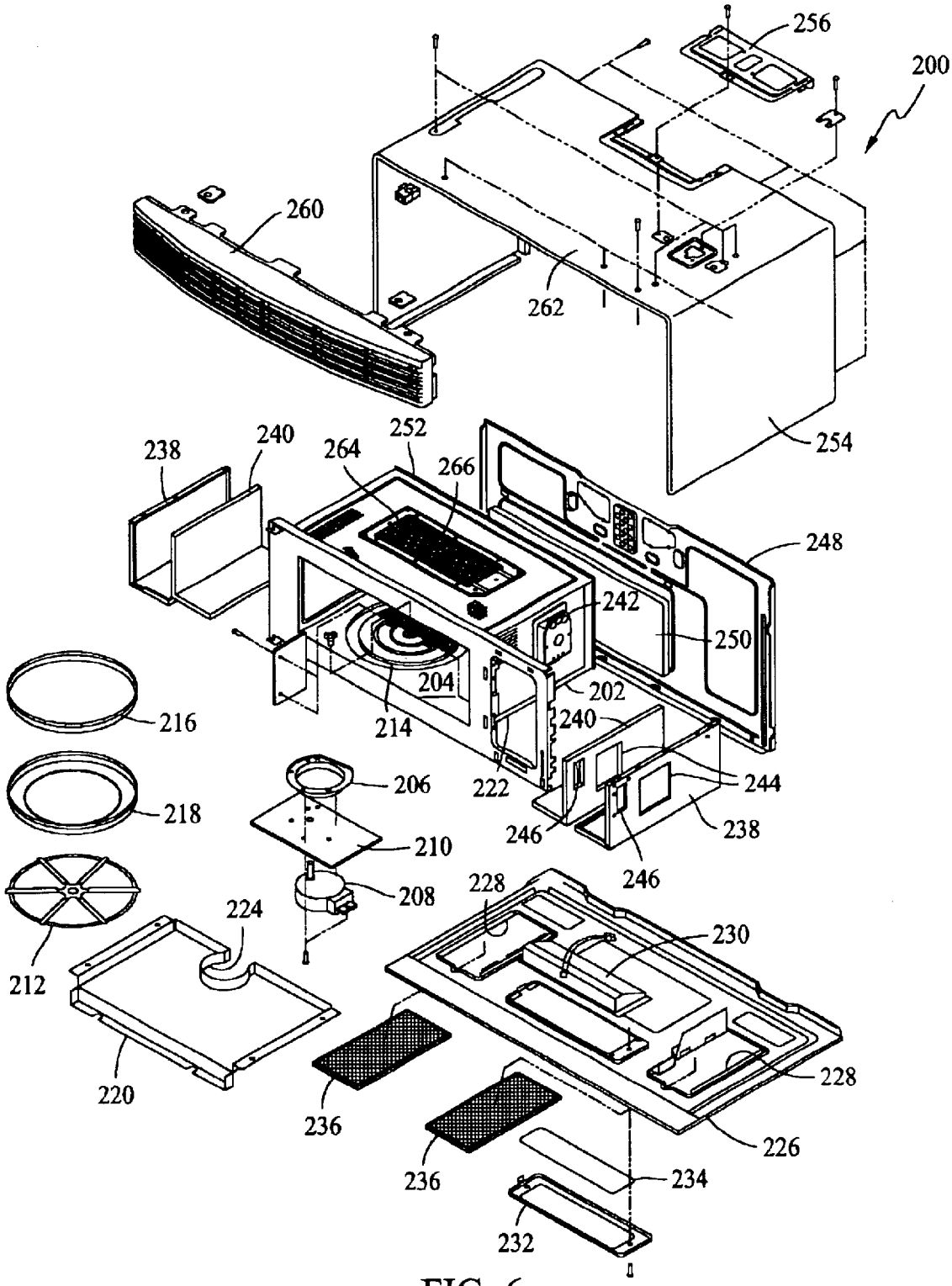
FIG. 6 is an exploded view of an oven cavity assembly.

More specifically, FIG. 6 is an exploded view of an oven cavity assembly 200. As shown in FIG. 6, cavity assembly 200 includes a cavity subassembly 202 that defines a cooking cavity 204. A turntable motor mount 206 and motor 208 are assembled to cavity subassembly 202, and a mica sheet 210 insulates motor 208 from motor mount 206. A turntable rack 212 is mounted on a turntable surface 214 defined within cavity 204. In one embodiment, rack 212 includes three circumferentially spaced wheels so that rack 212 rotates under the control of motor 208 and within cavity 204. Various trays, such as a black metal tray 216 and a glass tray 218, are mountable on rack 212. Oven 200 contains a 12V 10 W halogen lamp for illuminating cooking cavity 204 and making the food easily visible to the user.

A first bottom panel 220 is secured to a lower surface 222 of cavity subassembly 202, and bottom panel 220 includes an opening 224 for securing turntable motor 208. A second bottom panel 226 also is secured to cavity subassembly 202, and second bottom panel 226 includes vent openings 228, or inlets, as well as a reflector 230, a cooktop light panel 232 and cover 234. Filters 236 are positioned between second bottom panel 226 and cavity subassembly 202 for filtering air drawn therethrough.

Side panels 238 are mounted to opposing sides of cavity subassembly 202, and insulation panels 240 are positioned between each side panel 238 and subassembly 202. A magnetron mount 242 is mounted on a side of subassembly 202, and side panel 238 and insulation panel 240 include openings 244 for magnetron mount 242. Side panel 238 and insulation panel 240 also include vent openings 246. A back panel 248, including an insulation panel 250, is mounted to a back surface 252 of subassembly 202. Outer case 254 also mounts over subassembly 202, and a top plate 256 for a vent fan is mounted to outer case 254. A front grille 260 is mounted over cavity subassembly 202 and between subassembly 202 and an outer case top surface 262. A screen 264 secured to cavity includes a blocking portion 266 having a pattern that matches the shape of the sheath heater to reduce the amount of radiant energy from the sheath heater in the cavity.

Figure 7:
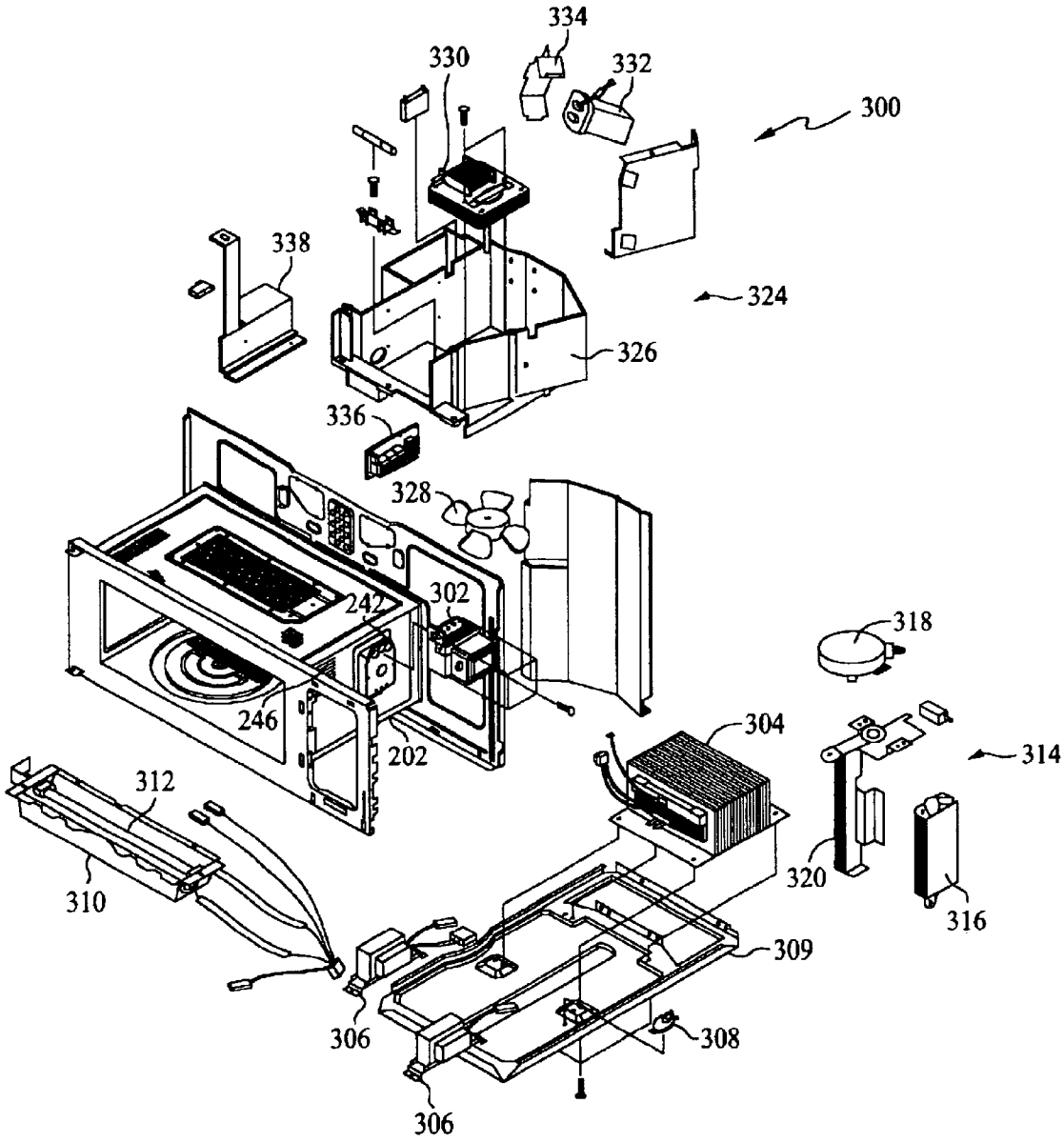
FIG. 7 is an exploded view of an oven interior assembly.

FIG. 7 is an exploded view of an oven interior assembly 300. As shown in FIG. 7, a magnetron 302 mounts to magnetron mount 242 on a side surface of cavity subassembly 202. In addition, a high voltage transformer 304, low voltage transformers 306, and a thermal cut-out (TCO) 308 mount to a base plate 309 that is secured to a bottom surface of subassembly 202. Also, reflector 310, having a ceramic heater 312 secured therein, is mounted to a bottom surface of subassembly 202. A damper assembly 314 including a damper door 316, motor 318, and mount 320 are arranged to mount over opening 246 in a side of subassembly 202. In addition, a fan assembly 324 for cooling magnetron 302 includes a fan housing 326, fan 328, a motor 330, a capacitor 332 and a capacitor bracket 334. A control board 336 having heater relays secured thereto also is mounted by mount 338 to cavity subassembly 202.

Figure 8:
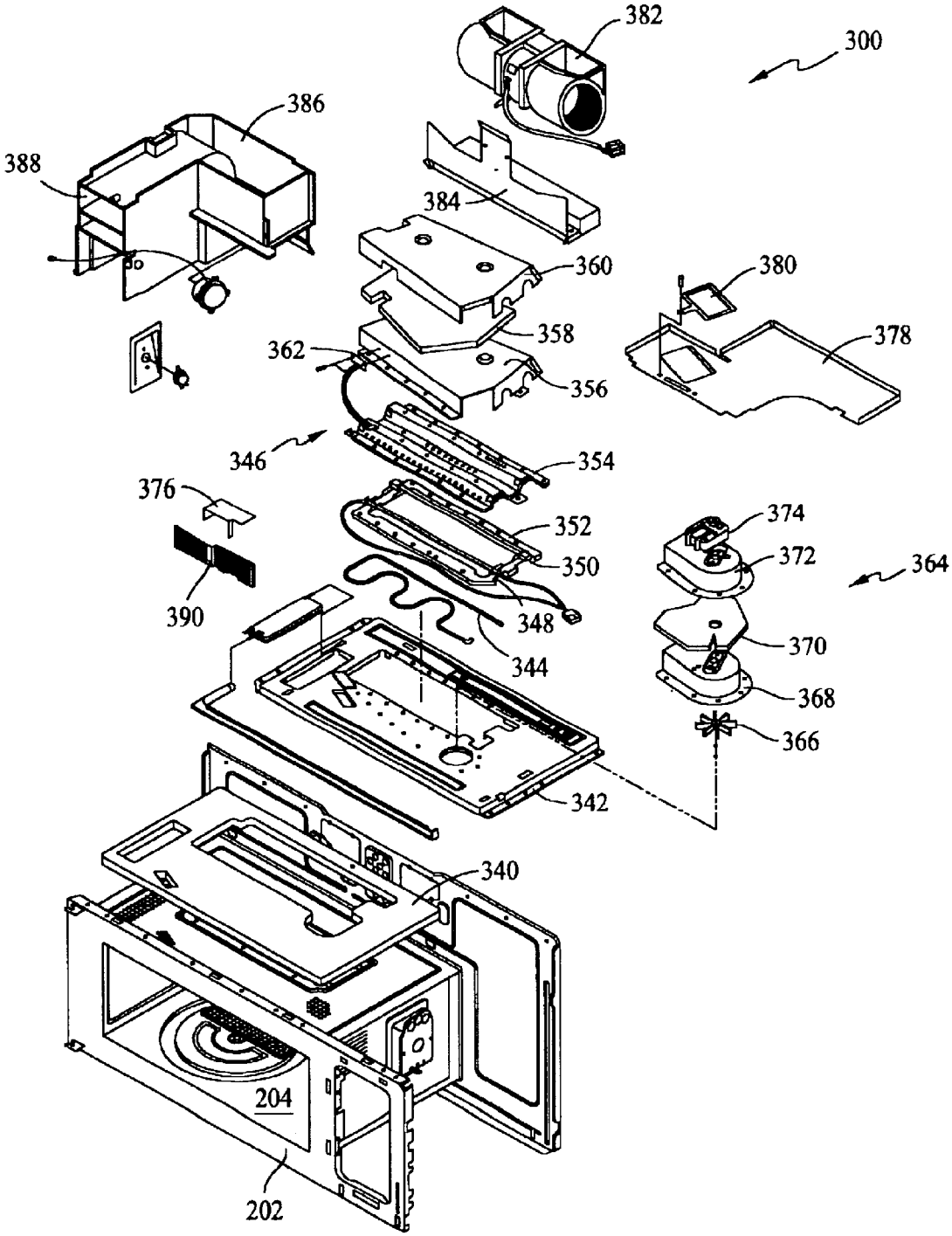
FIG. 8 is an exploded view of additional components of an oven interior assembly.

FIG. 8 is an exploded view of additional components of oven interior assembly 300. An insulation panel 340 is located over cavity subassembly 202, and a top plate 342 is located over panel 340. A sheath heater 344 is secured to top plate 342, as well as a heater/lamp assembly 346. Heater assembly 346 includes a ceramic heater 348 and a halogen lamp 350 secured within a mount 352. A reflector 354 is secured to mount 352 for directing energy into cavity 204. An air chamber housing 356 is located over reflector 354, and an insulation panel 358 and a housing plate 360 are secured over air chamber housing 356. A thermistor 362 is located within the air chamber defined by housing 356.

A convection fan assembly 364 including a convection fan 366, a lower casing 368, an insulation pad 370, an upper casing 372, and a motor 374, are secured in flow communication with air chamber housing 356. A top cover 376 extends over motor 374, and a cover plate 378 mounts over convection fan assembly 364. An access panel 380 for access to the cavity light is secured to cover plate 378. A vent fan 382 is secured to a fan mount 384 that secures to top plate 342.

A plastic housing 386 defining an air flow path and having a damper therein (not shown) also is secured to top plate 342. Housing 386 includes a chamber 388 for air flow which facilitates the removal of moisture from oven cavity 204 during microwave cooking. The damper door is open during microwaving to allow moisture to escape the cooking cavity and it is closed during cooking modes that employ the heaters to ensure heat remains in the cooking cavity. A front grill protruder 390 also mounts to top plate 342.

Figure 9:
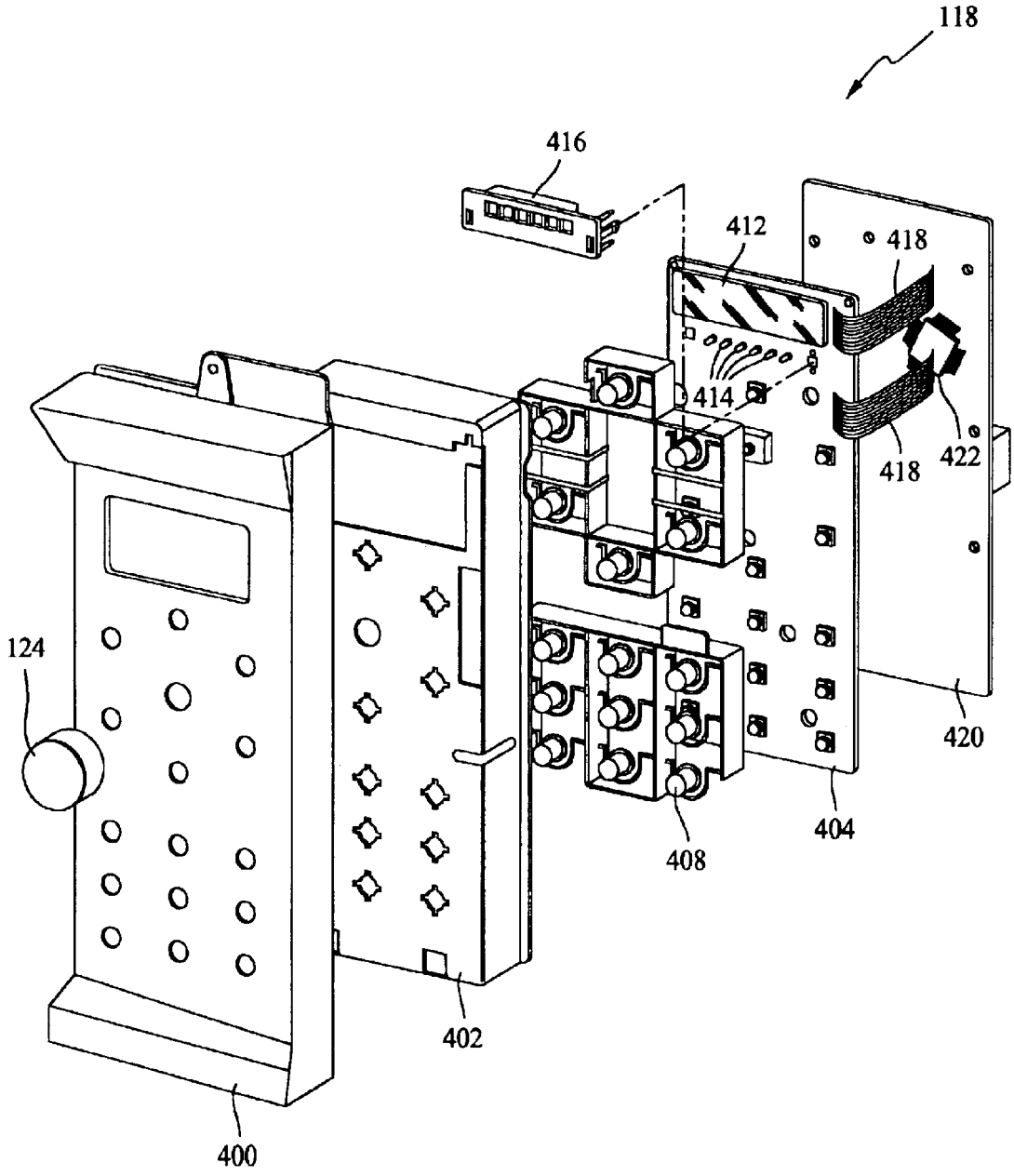
FIG. 9 is an exploded view of an oven controller.

FIG. 9 is an exploded view of oven controller 118. Controller 118 includes an exterior panel 400. Rotary 124 dial extends from panel 400 and is rotatable relative to panel 400. A grounding plate 402 is located behind exterior panel 400 and between exterior panel 400 and a key panel 404. A push button assembly 406 mounts to key panel 404, and push buttons 408 extend through openings 410 in grounding plate 402 and exterior panel 400. Key panel 404 also includes a display 412 as well as light emitting diodes (LEDs) 414. A shield 416 mounts to key panel 404 and over LEDs 414. Ribbon connectors 418 extend from key panel 404 to a control board 420. A microprocessor 422 as well as other components as described below in more detail are mounted to control board 420.

Figure 10:
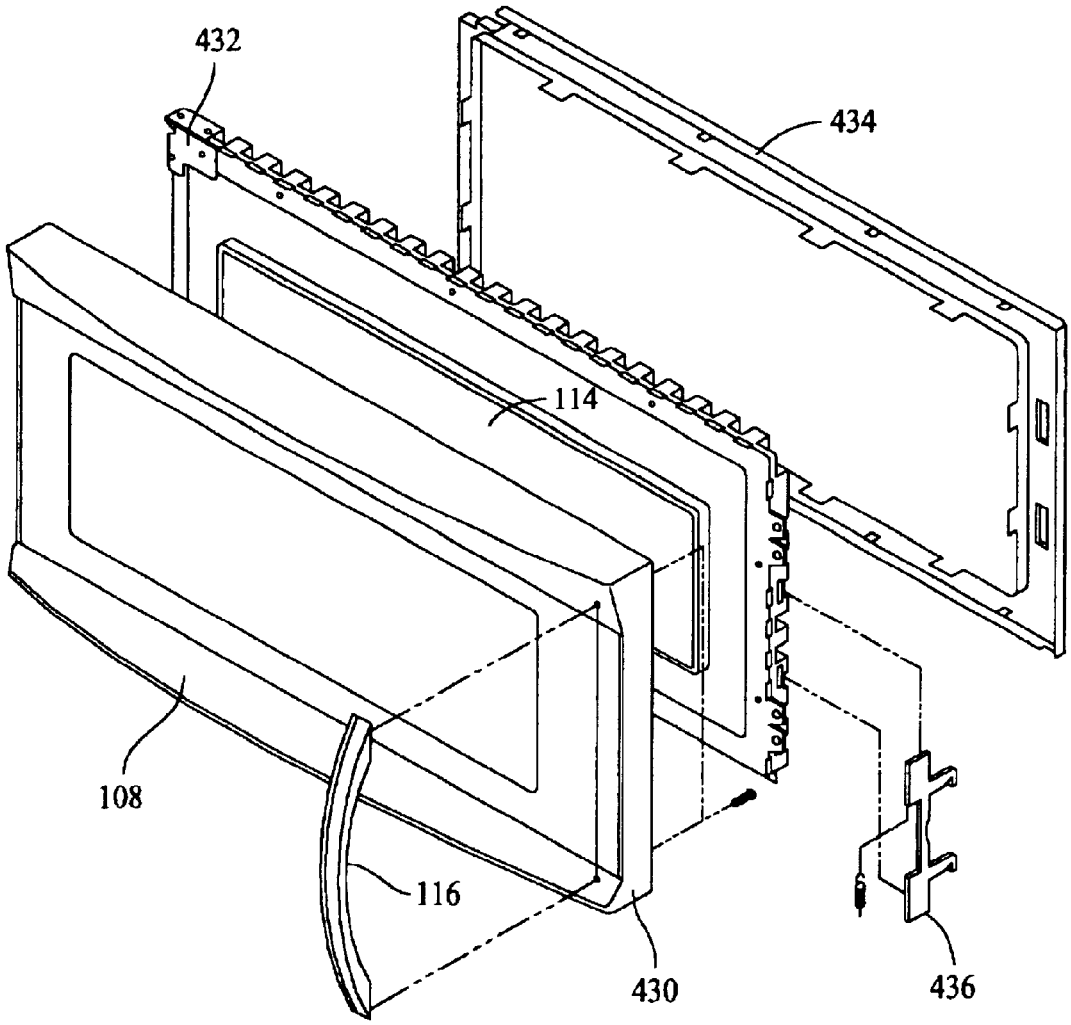
FIG. 10 is an exploded view of an oven door.

FIG. 10 is an exploded view of oven door 108. Door 108 includes an injection molded door frame 430 and handle 116 secured thereto. A microwave choke 432 including glass window 114 is secured to door frame 430 by a choke cover 434. Door 108 is mounted to cavity subassembly 202 by a latch 436.

Figure 11:
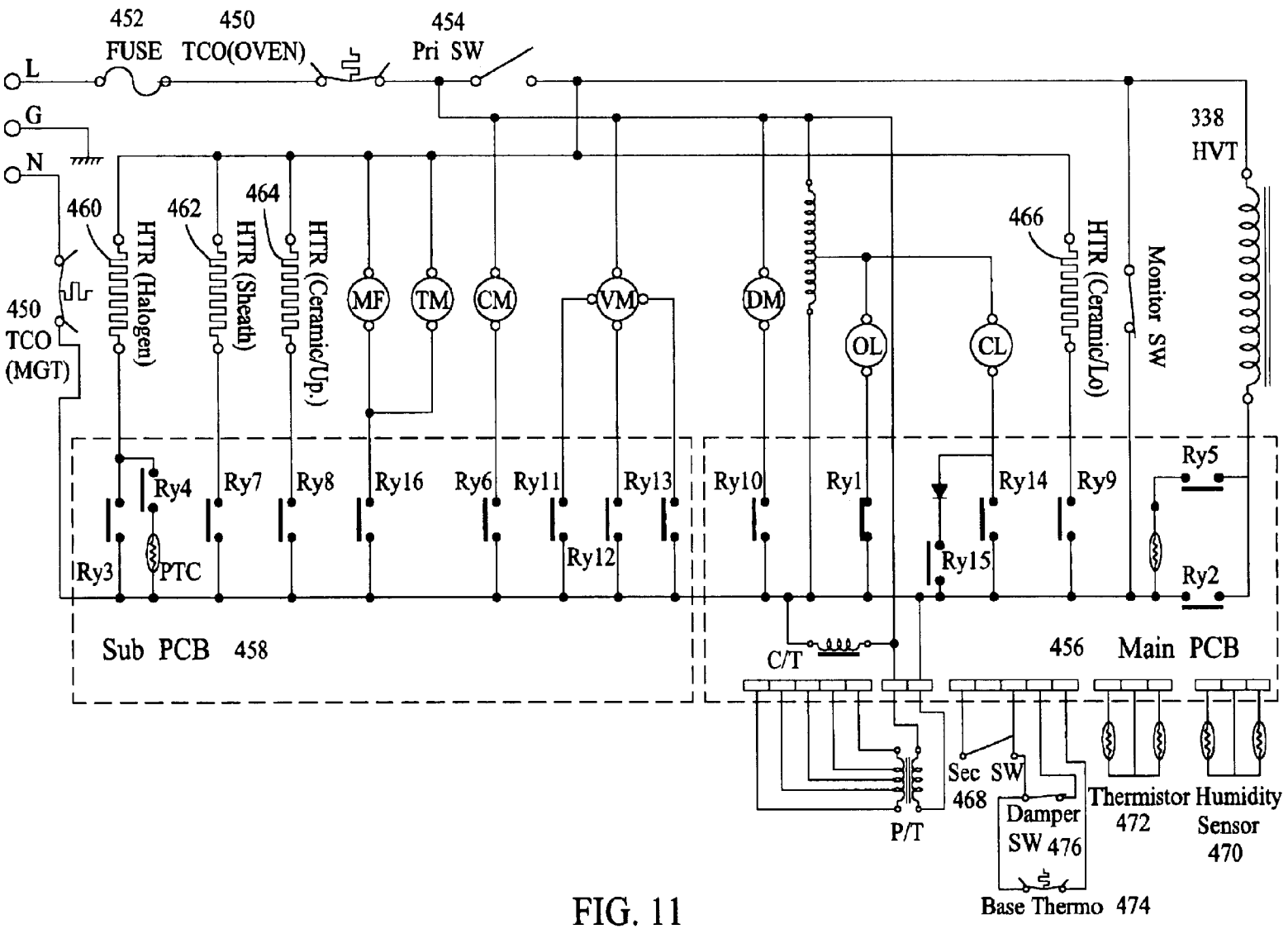
FIG. 11 is a schematic illustration of an oven control.

FIG. 11 is a schematic illustration of oven control. Power is provided to oven 100 via lines L1, G, and N. Thermal cut outs 450 and a fuse 452 also are provided to protect oven components, e.g., from overheating or an overcurrent condition. A primary interlock switch 454 is located in the oven door and prevents energization of cooking elements unless door is closed. Relays R1, R2, R5, R9, R10, R14, and R15 are secured to a main printed circuit board (PCB) 456 and relays R3, R4, R7, R8, R11, R12, R13, and R16 are mounted on a sub PCB 458. Relays R1–R16 are coupled to a micro computer on main PCB which is programmed to control the opening and closing thereof. Relays R1–R16 are electrically connected in series with thermal cut out (TCO) 450.

Energization of halogen lamp 460 is controlled by relays R3 and R4. To increase reliability of the halogen lamp, a soft start operation can be used. Particularly, in accordance with the soft start operation, a triac connected in series with lamp 460 delays lamp turn-on. For example, lamp 460 may be delayed for one second from commanded turn-on to actual turn-on.

Energization of sheath heater 462 is controlled by relay R7. Energization of upper ceramic heater 464 is controlled by relay R8. Energization of lower ceramic heater 466 is controlled by relay R9.

Oven 100 also includes a magnetron fan (MF) and a turn table motor (TM) controlled by relay R16. Convection fan motor (CM) is controlled by relay R6, and vent motor (VM) is controlled by relays R11, R12, and R13. Damper motor (DM) is controlled by relay R10. Oven light (OL) and cooktop light (CL) are controlled by relays R1, R15, and R14.

Relays R5 and R2 control energization of the microwave module which includes a high voltage transformer 338 which steps up the supply voltage. As also shown in FIG. 11, oven 100 includes a door sensing switch 468 for sensing whether door is opened, a humidity sensor 470 for sensing the humidity in cooking cavity, a thermistor 472, a base thermostat 474, and a damper switch 476.

Figure 12:
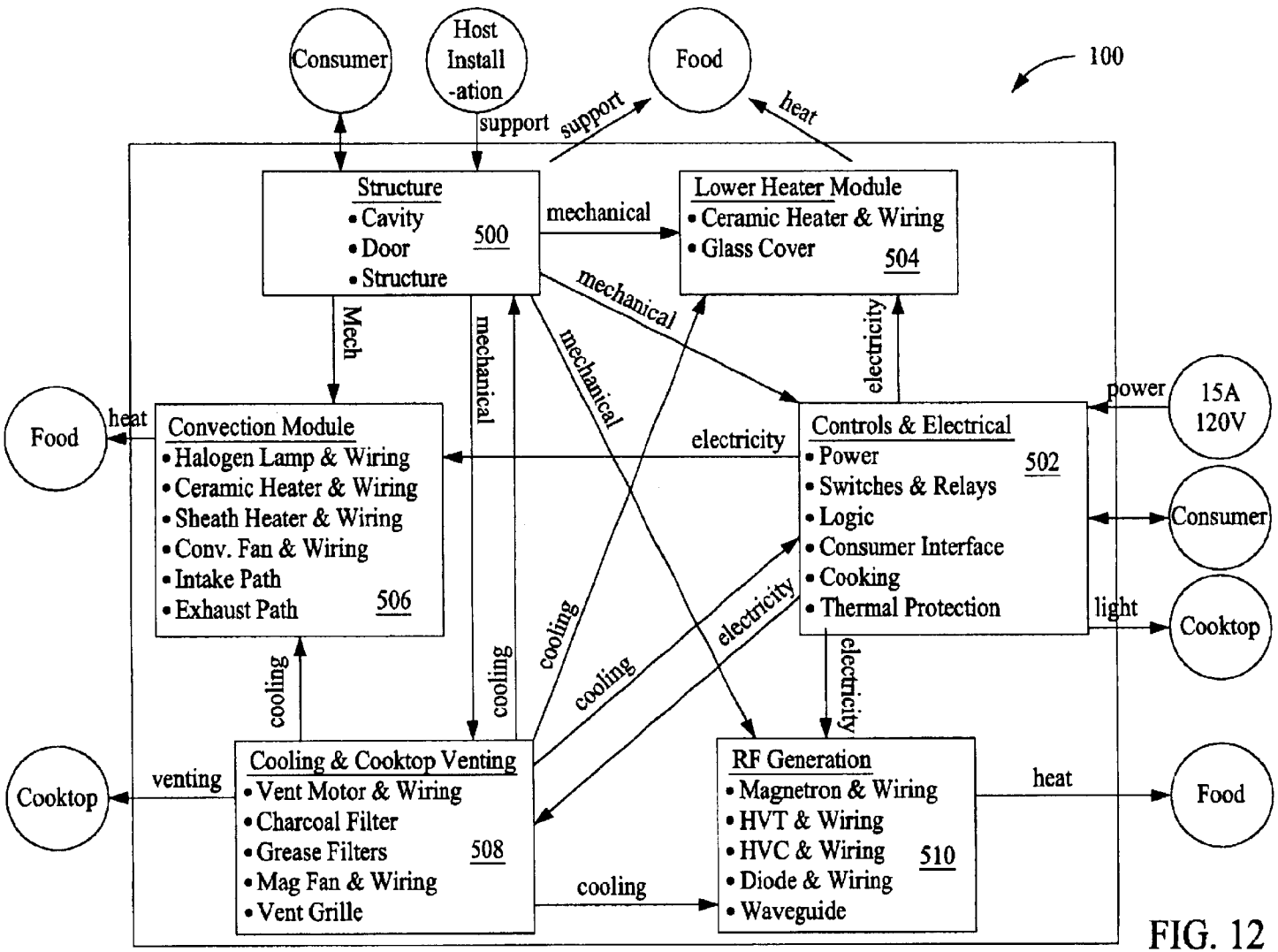
FIG. 12 is a functional block diagram of an oven.
Figure 13:
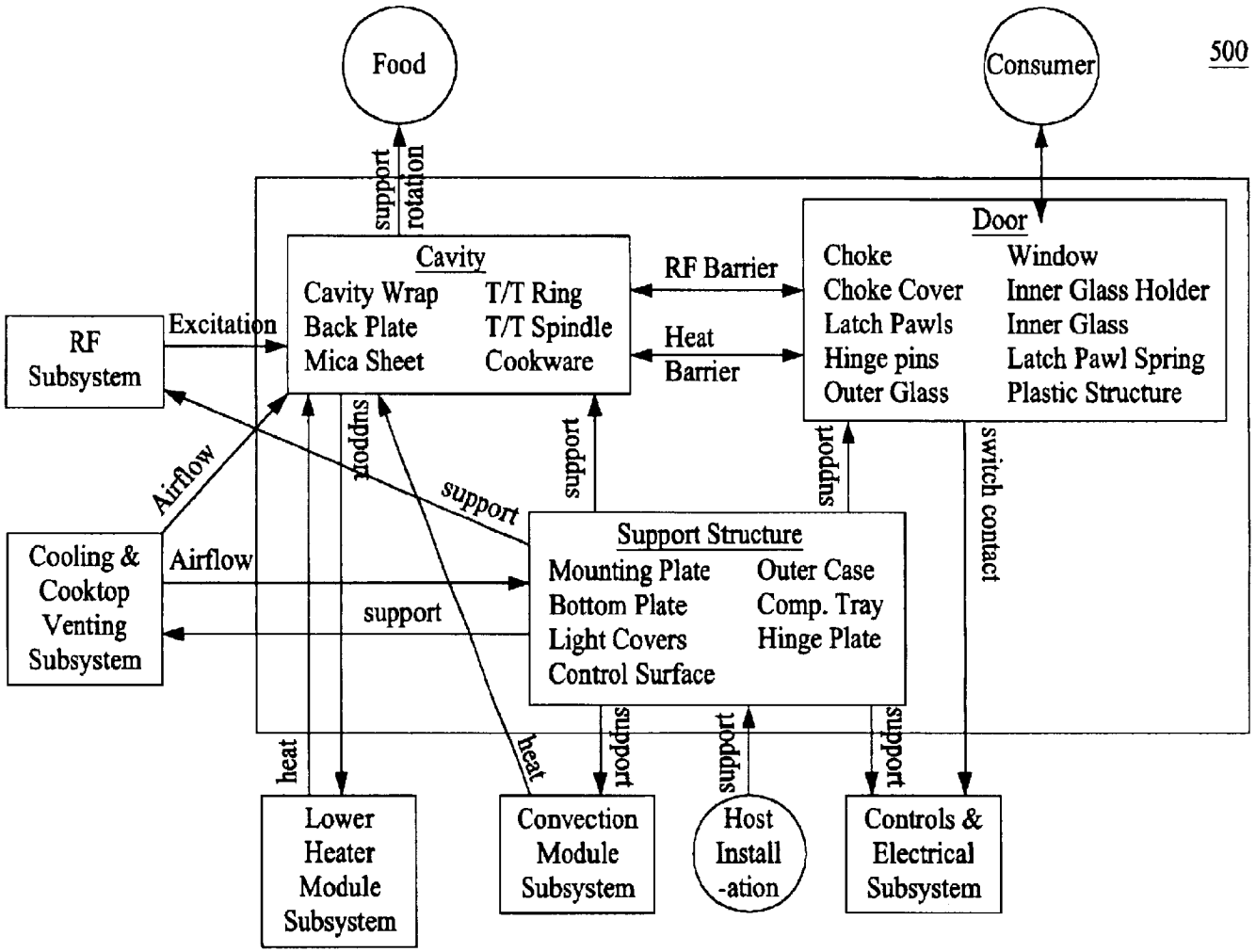
FIG. 13 is a functional block diagram of a structural subsystem of an oven.
Figure 14:
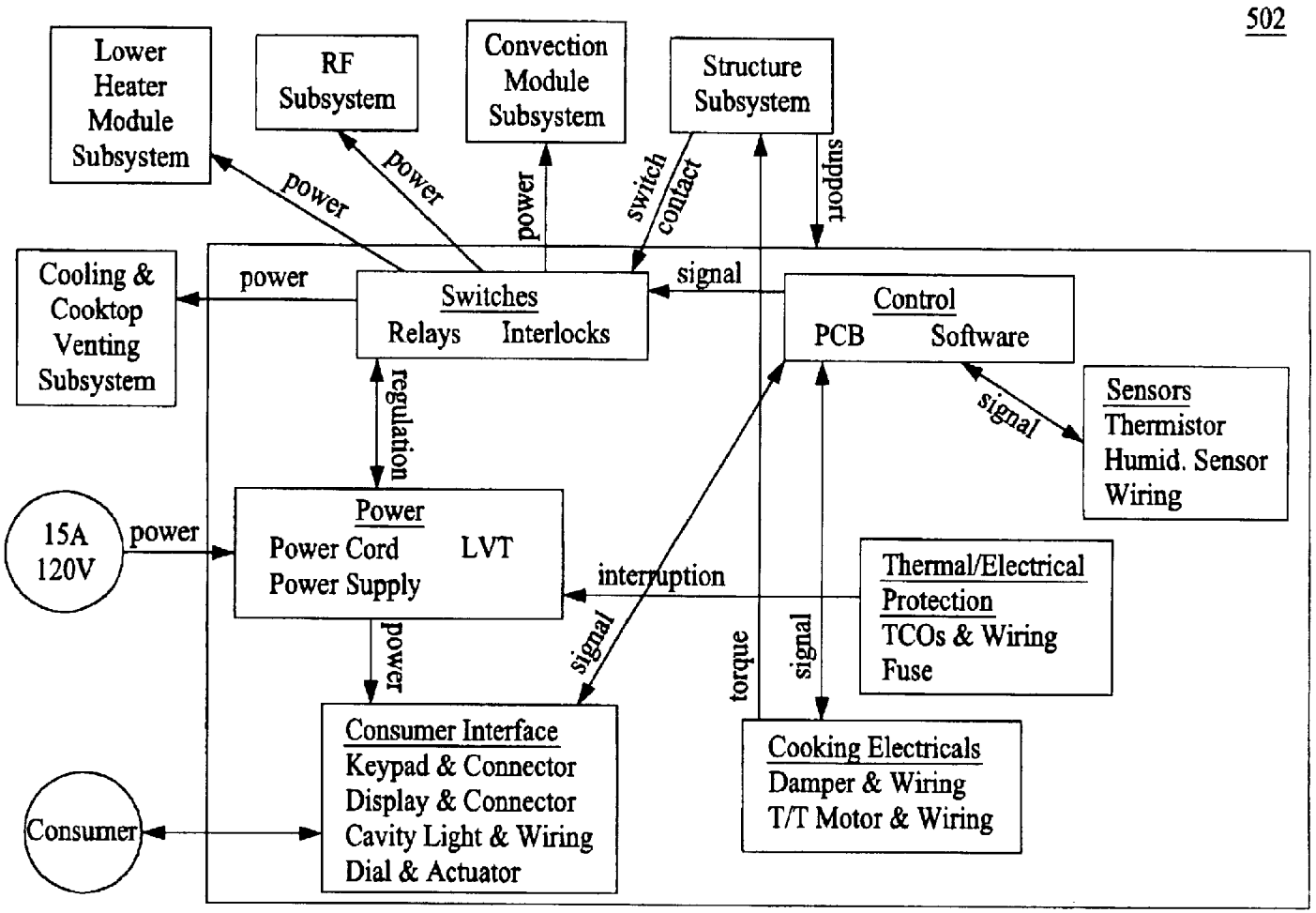
FIG. 14 is a functional block diagram of a control and electrical subsystem of an oven.
Figure 15:
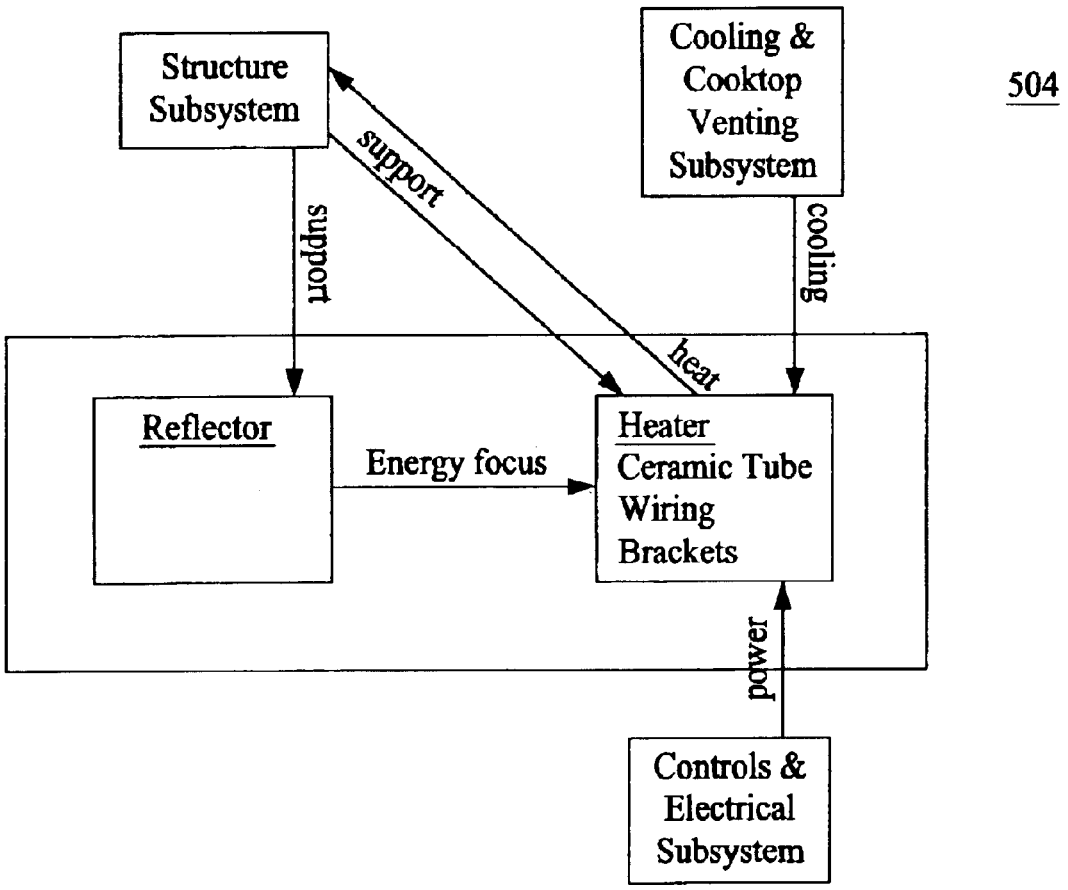
FIG. 15 is a functional block diagram of a lower heater module subsystem of an oven'
Figure 16:
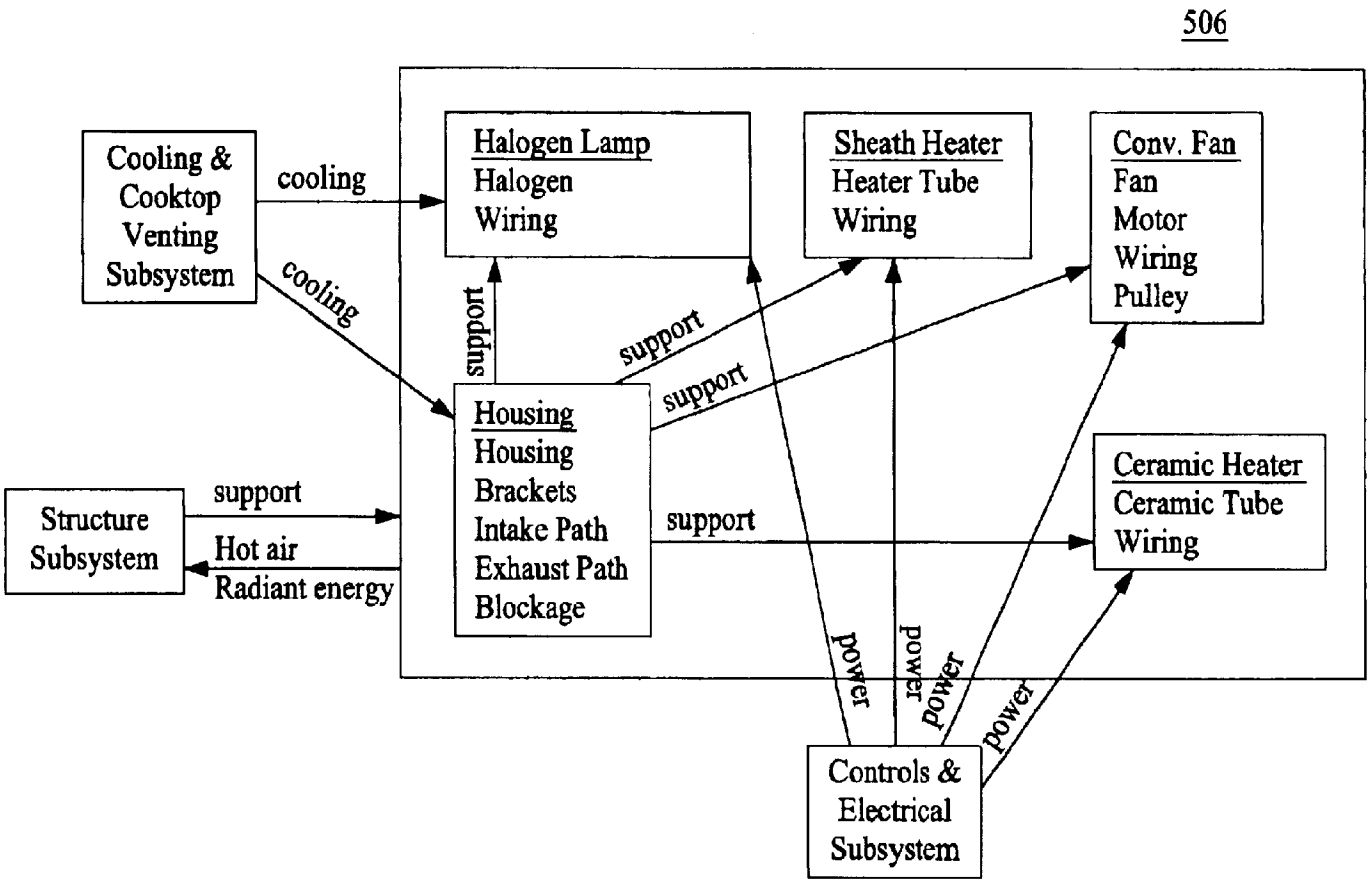
FIG. 16 is a functional block diagram of a convection module subsystem of an oven.
Figure 17:
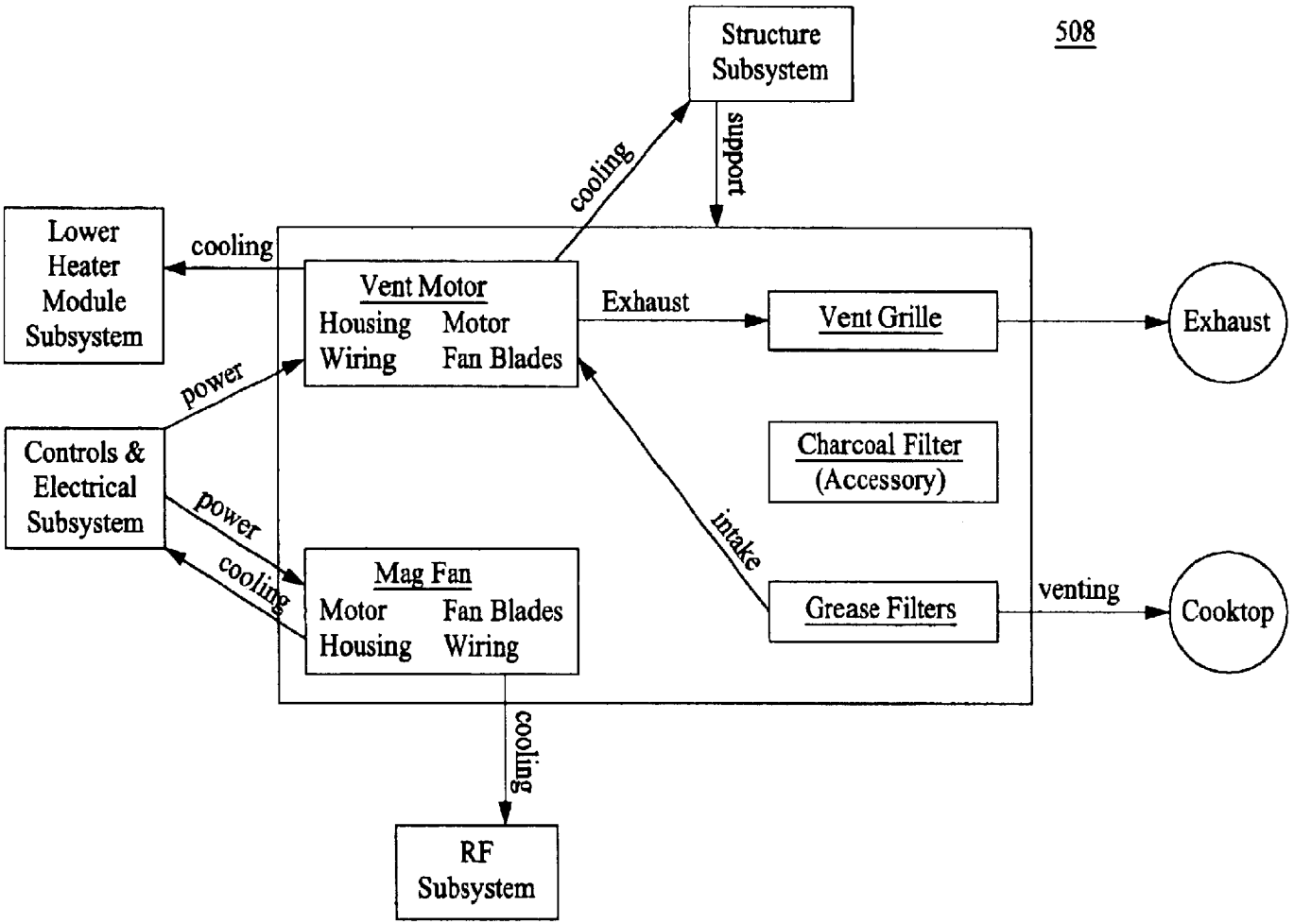
FIG. 17 is a functional block diagram of a cooling and cooktop venting subsystem of an oven.
Figure 18:
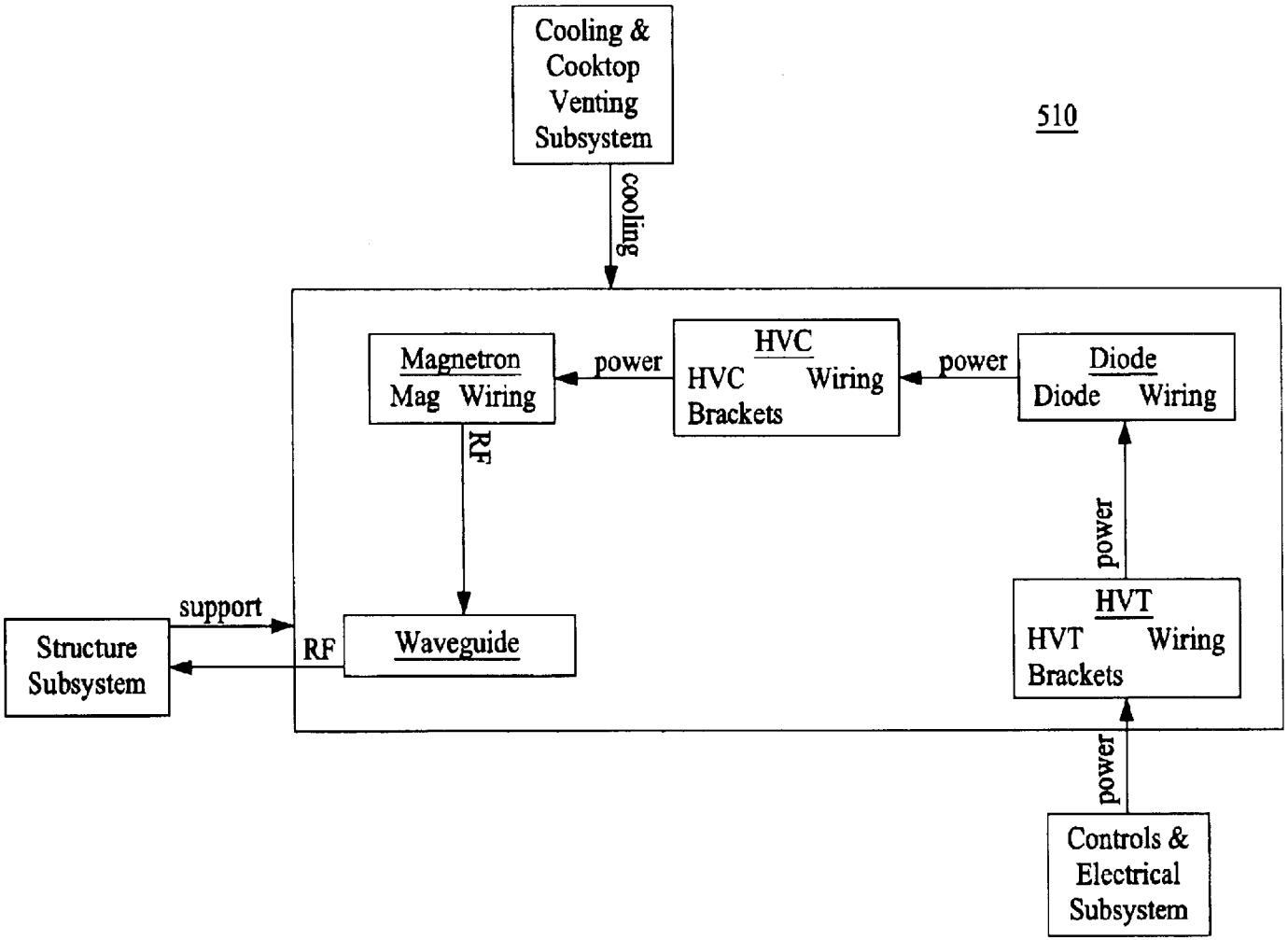
FIG. 18 is a functional block diagram of an RF generation subsystem of an oven.

FIG. 12 is a functional block diagram of oven 100. As shown in FIG. 12, oven 100 includes a structural subsystem 500, a controls and electrical subsystem 502, a lower heater module subsystem 504, a convection module subsystem 506, a cooling and cooktop venting subsystem 508, and an RF generation subsystem 510. Various features of each system are indicated in FIG. 12. In addition, FIG. 13 illustrates additional functional details on structural subsystem 500, FIG. 14 illustrates additional functional details on controls and electrical subsystem 502, FIG. 15 illustrates additional functional details on lower heater module subsystem 504, FIG. 16 illustrates additional functional details on convection module subsystem 506, FIG. 17 illustrates additional functional details on cooling and cooktop venting subsystem 508, and FIG. 18 illustrates additional functional details on RF generation subsystem 510.

Figure 19:
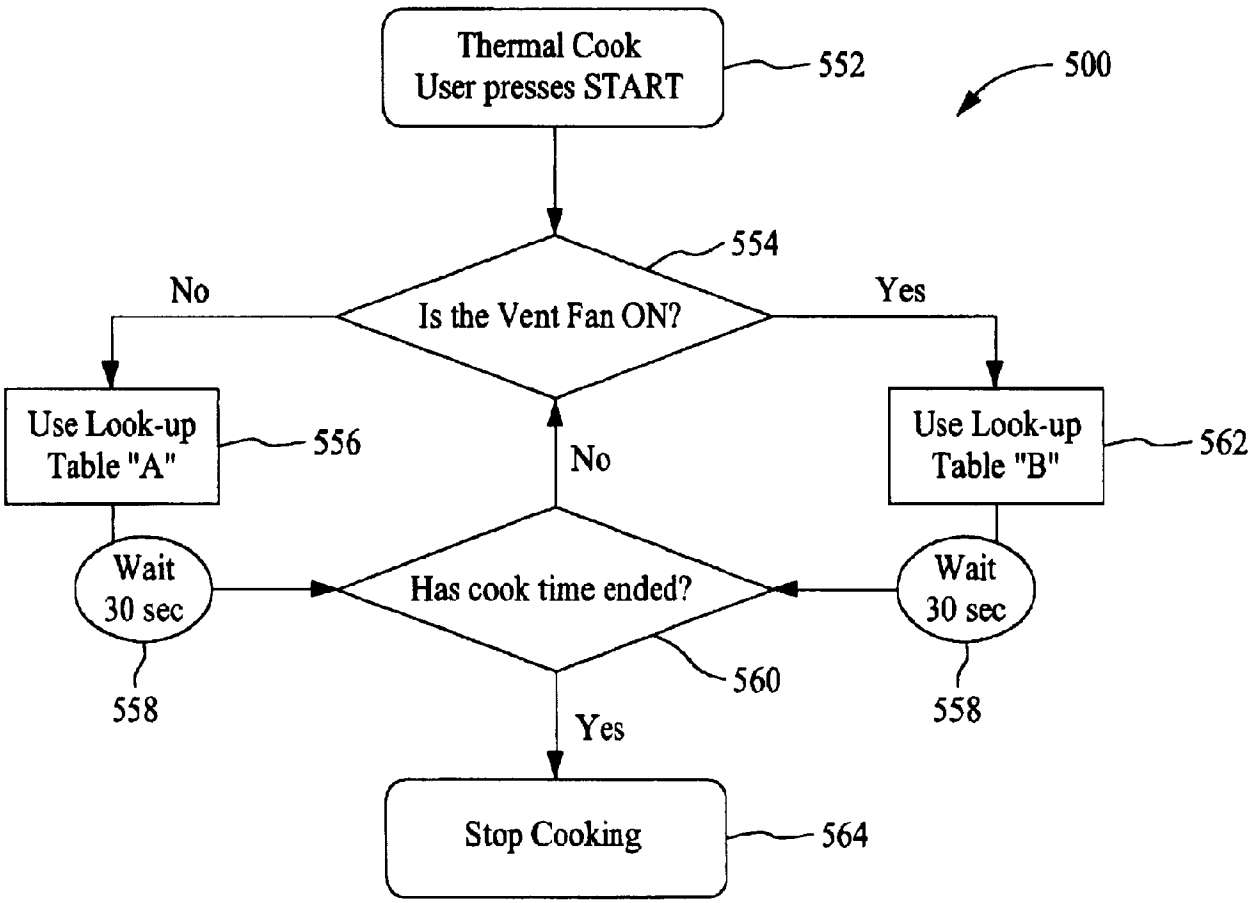
FIG. 19 is a flow chart illustrating process steps for venting compensation.

As explained above, a thermistor 362 is located within the air chamber defined by housing, i.e., in the vent airflow path from the vent fan. Output from the thermistor is representative of a temperature in the cooking cavity. A temperature sensed by the thermistor can be affected, however, by the vent fan airflow. Specifically, when the vent fan is on, it is possible that a signal generated by the thermistor will represent a lower temperature than the actual temperature in the cooking cavity. FIG. 19 is a flow chart 550 illustrating process steps executed by micro computer to adjust for inaccuracies that may result from sampling the output signal from the thermistor when vent fan air is flowing over, and therefore cooling, the thermistor.

Specifically, during a thermal cook cycle and after a user selects "Start" 552 on the keypad, the micro controller determines whether the vent fan is ON 554, e.g., by checking the state of vent fan relay. If the vent fan is not on, then the temperature represented by the thermistor output signal is adjusted in accordance with the values in look-up Table A 556, below. For example, and in one specific embodiment, if the thermistor output signal represents a temperature of 223 degrees and if the fan is not on, then the actual cooking cavity temperature is 250 degrees. After sampling the thermistor, then a 30 second delay 558 is entered. If cooking time has not ended 560, micro computer once again determines whether the vent fan is on 554.

If the vent fan is on 554 at the time of sampling thermistor, then look-up Table B 562, below, is utilized. For example, if the thermistor output signal represents a temperature of 214 degrees and if the fan is on, then the actual cooking cavity temperature is 250 degrees. Every thirty seconds 558 the control checks to see if the vent fan is on. The target thermistor reading is adjusted accordingly throughout the cooking time until cooking stops 564.

Of course, the specific values for the thermistor readings and the corresponding oven cavity temperatures can vary depending on the specific configuration of the oven, the type of thermistor utilized, and the amount of impact vent fan airflow has on the thermistor. The values set forth below in Tables A and B are, therefore, exemplary only.

TABLE A

| Cavity Temp. | Plug-in (no fan) |
|---|---|
| 250 | 223 |
| 275 | 242 |
| 300 | 261 |
| 325 | 281 |
| 350 | 300 |
| 375 | 319 |
| 400 | 338 |
| 425 | 357 |
| 450 | 376 |

TABLE B

| Cavity Temp. | Plug-in (with fan) |
|---|---|
| 250 | 214 |
| 275 | 232 |
| 300 | 251 |
| 325 | 270 |
| 350 | 288 |
| 375 | 306 |

TABLE B-continued

| Cavity Temp. | Plug-in (with fan) |
|---|---|
| 400 | 324 |
| 425 | 343 |
| 450 | 362 |

Figure 20:
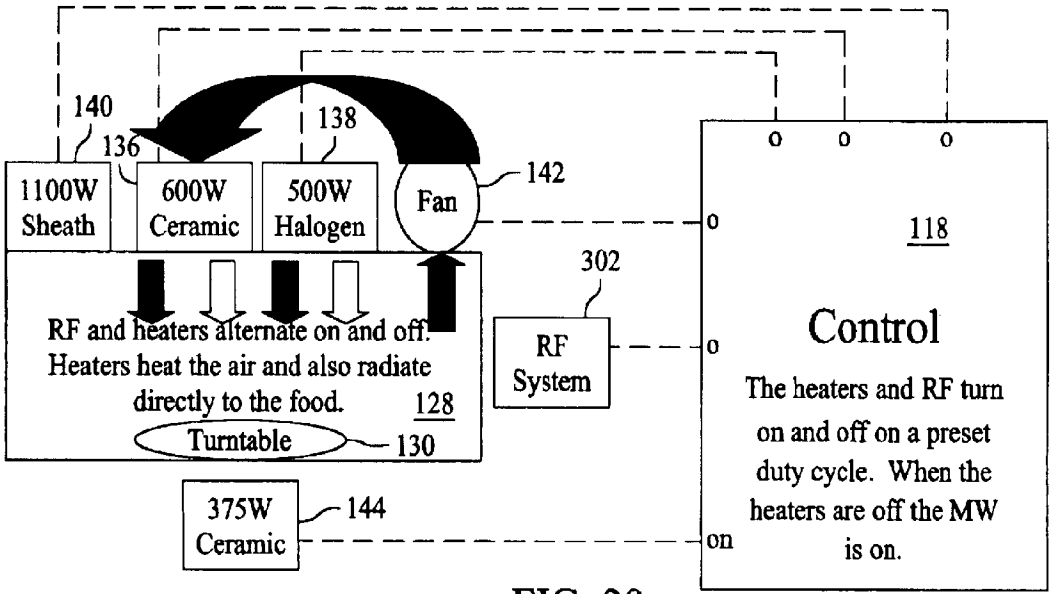
FIG. 20 is a block diagram illustration of a speedcook mode.

FIG. 20 is a block diagram illustration of a speedcook mode. In the speedcook mode, sheath heater 140 is off, upper ceramic heater 136 is on, halogen lamp 138 is on, lower ceramic heater 144 is on, and RF system 302 is on. Control 118 energizes and de-energizes the upper and lower ceramic heaters, the halogen lamp, and the RF system to heat the air and also radiate energy directly to the food on turntable 130.

Figure 21:
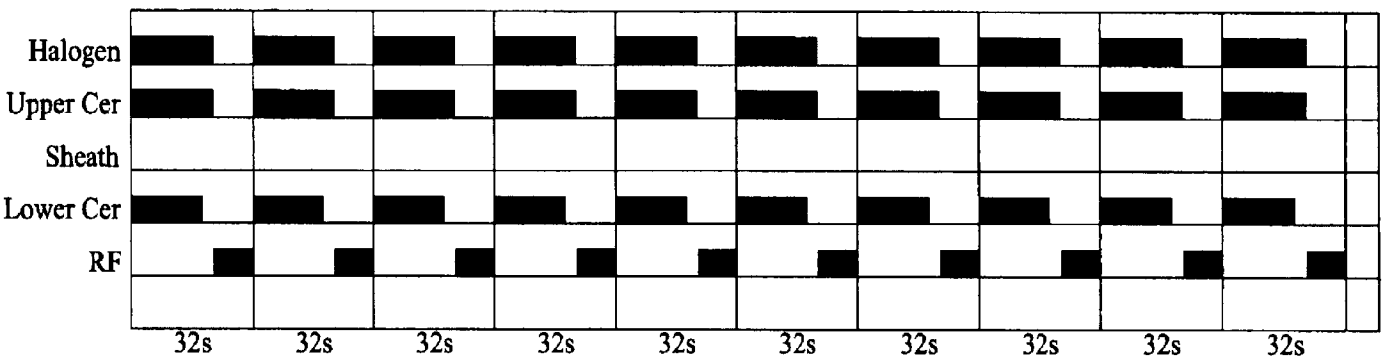
FIG. 21 illustrates duty cycles for the speedcook mode illustrated in FIG. 20.

More specifically, and as shown in FIG. 21, in an exemplary embodiment, control 118 operates the cooking elements on a 32 second duty cycle. The length of time each component is on during a particular cycle varies depending on the power level selected. In addition, and as shown in FIG. 21, during the speedcooking mode, while the halogen lamp and ceramic heaters are energized, the RF system is not energized. Similarly, when the RF system is energized, the halogen lamp and ceramic heaters are not energized. Such control of the duty cycle enables use of the 120V source.

The ratio of the heater on time and microwave on time can be precisely controlled. Different foods will cook best with different ratios. The oven allows control of these power levels through both pre-programmed cooking algorithms and through user-customizable manual cooking.

In addition, and for the speedcook mode, it is possible that the speedcook operations follow a previous cooking operation. As a result, the cooking cavity may be heated rather than cool. If the cooking cavity is heated, then to achieve the desired cooking, it may be necessary to adjust the cooking algorithm to compensate for energy already present in the cooking cavity at the time speedcooking is initiated.

Figures 22, 23:
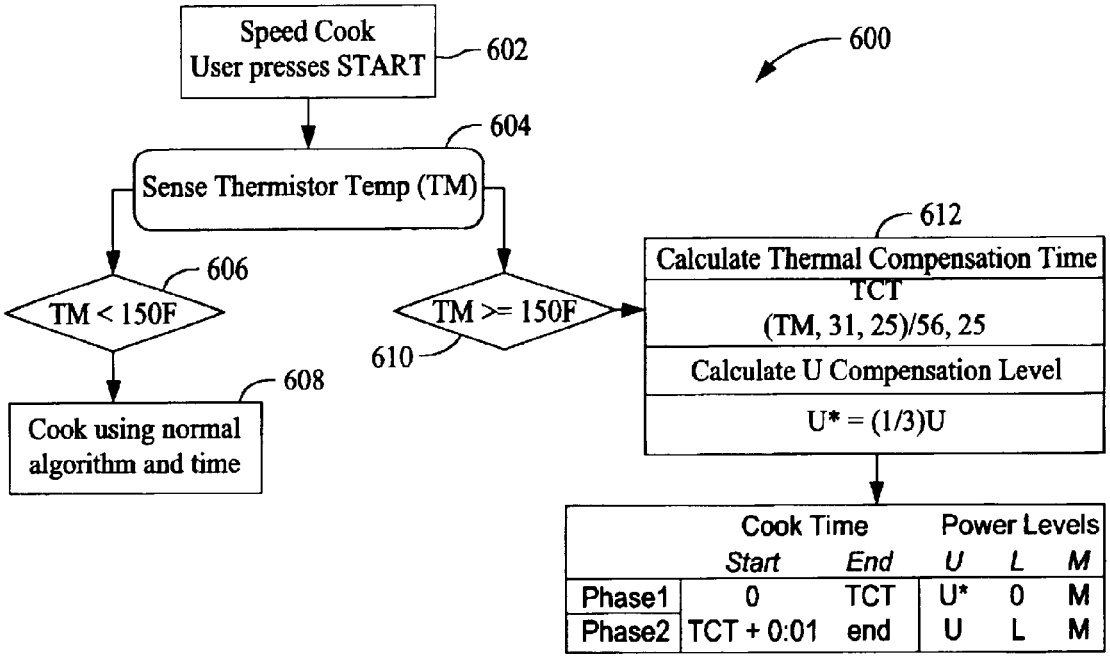

An algorithm 600 for performing such compensation is illustrated in FIG. 22. Specifically, once "Speedcook" is selected 602, the cooking cavity temperature is determined 604 by the micro controller. The micro controller samples the thermistor and determines whether the thermistor sample value is less than 150 degrees F. 606 or greater than or equal to 150 degrees F. 608. If the temperature is less than 150 degrees F., then the normal cooking algorithm and time are used 610, i.e., no adjustment is made. If, however, the temperature is greater than or equal to 150 degrees F., then a thermal compensation is performed 612.

For thermal compensation, a thermal compensation time (TCT) is determined in accordance with:

$$TCT=(TM-31.25)/56.25,$$

and a compensation level U* is determined in accordance with:

$$U^*=(1/3)U.$$

For example, and referring to the tables illustrated in FIGS. 23, 24 and 25, if the temperature is 150 degrees F., then the thermal compensation time (TCT) is equal to 2 minutes and 7 seconds. If the total cooking time is, for example, 5 minutes, then the time during which the thermal compensation is performed is from 0 seconds to 2 minutes and 7 seconds. The thermal compensation amounts to ⅓ of the power level under which normal cooking was scheduled to occur, i.e., Phase 1. For example, if normal cooking is for the lower and upper heaters to be on for a full duty cycle, i.e., for 32 seconds, then during Phase 1, the upper heaters are on for 11 seconds (i.e., about ⅓ of 32 seconds). The lower heater is not on at all during Phase 1. At 2 minute and 8 seconds until the end of the cooking cycle, then normal cooking as scheduled is performed, i.e., Phase 2. The Phase 1 and Phase 2 duty cycles illustrated in FIGS. 24 and 25 are, of course, exemplary only.

Figure 26:
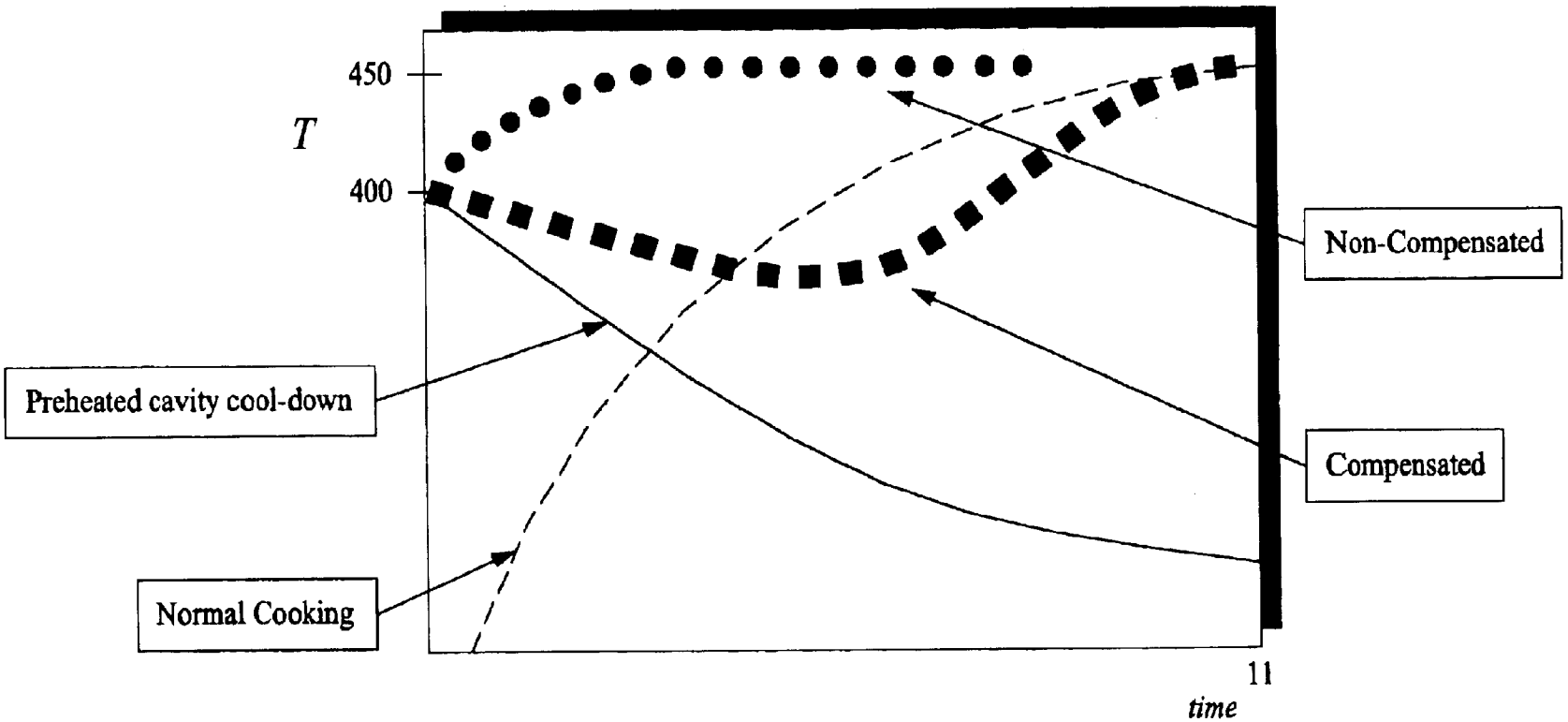
FIG. 26 is a graph illustrating cooking cavity temperature with and without thermal compensation.

Generally, an objective of the thermal compensation described above is to provide a temperature curve as illustrated in FIG. 26. Specifically, at time 0, if speedcooking is initiated with the cooking cavity fully cooled, then the temperature in the cooking cavity rises as indicated by the "Normal Cooking" line. If, however, the cooking cavity is at 400 degrees if speed cooking were to be initiated without thermal compensation, then the temperature of the cooking cavity would follow the non-compensated line. That is, the temperature in the cooking cavity would rise to much higher temperatures much faster than if the cooking cavity is cooled down when speed cooking is initiated. As a result, more energy is input to the food and the food may be more cooked than planned.

Rather than instructing a user to wait for the cooking cavity to cool, the thermal compensation algorithm allows the cooking cavity to cool down from 400 degrees and may actually fall below the temperature that would be achieved by "Normal Cooking" during Phase I to compensate for the initially higher cooking cavity temperature. During Phase 2, the control algorithm is no longer adjusted and the cooking cavity temperature tracks with the temperature that would be provided with Normal Cooking.

Figure 27:
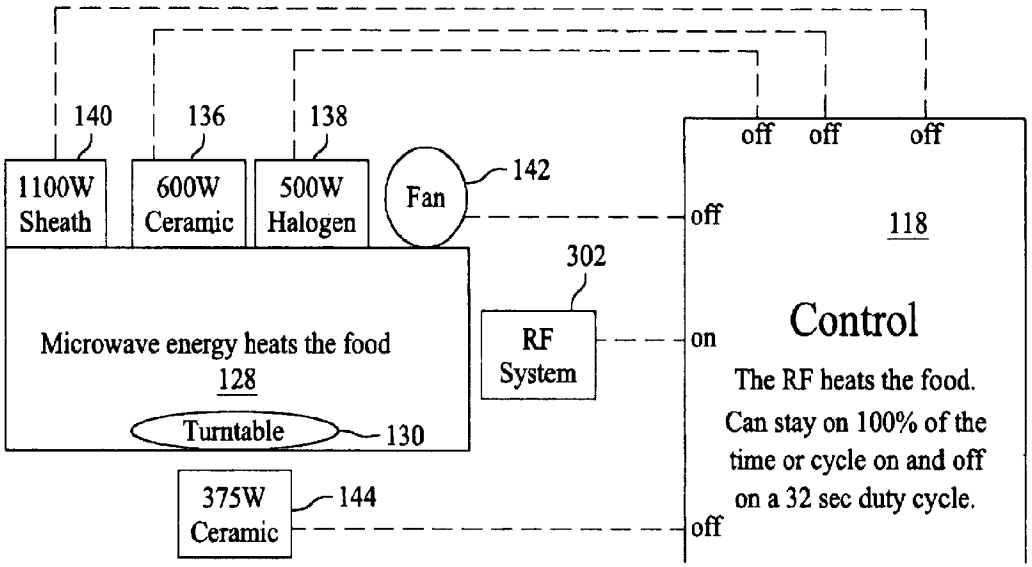
FIG. 27 is a block diagram illustration of a microwave mode.
Figure 28:
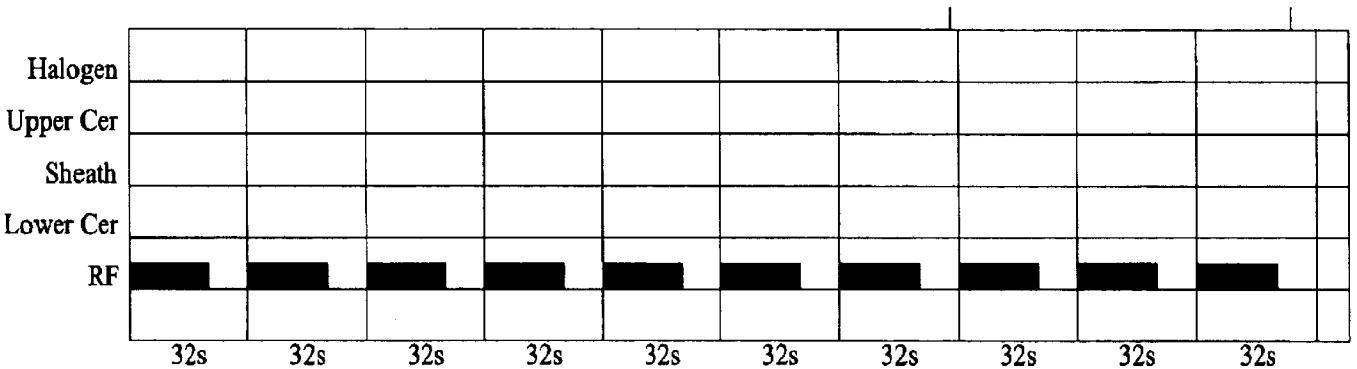
FIG. 28 illustrates duty cycles for the microwave mode illustrated in FIG. 27.

FIG. 27 is a block diagram illustration of a microwave mode. In the microwave mode, only the RF system is on during the cooking cycle. Microwave energy from the magnetron heats the food. As shown in FIG. 28, the RF system can be energized for 100% of the duty cycle, or can cycle on and off for an amount of time based on the selected power level during each duty cycle.

Figure 29:
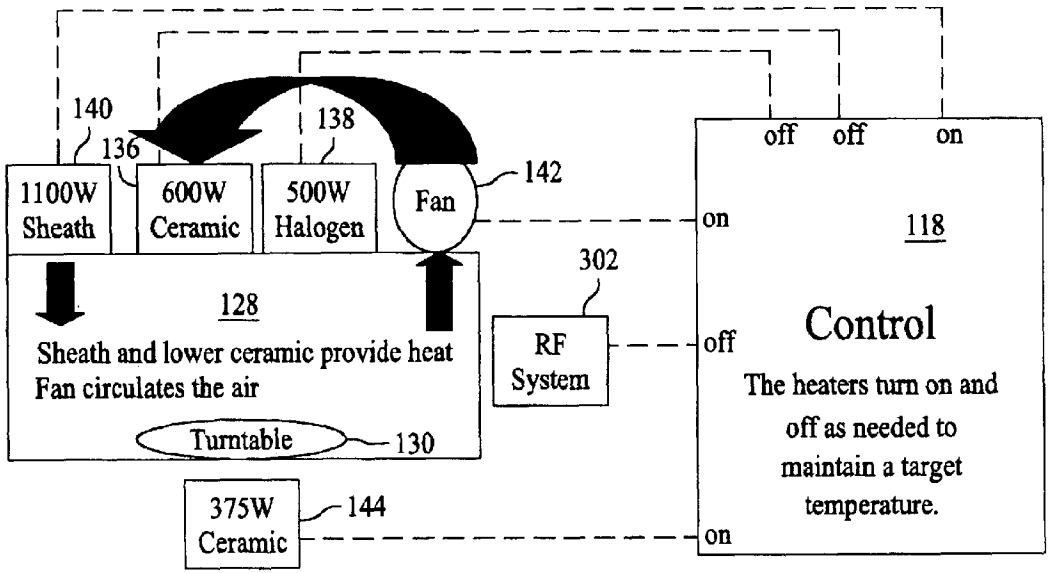
FIG. 29 is a block diagram illustration of an oven/bake mode.
Figure 30:
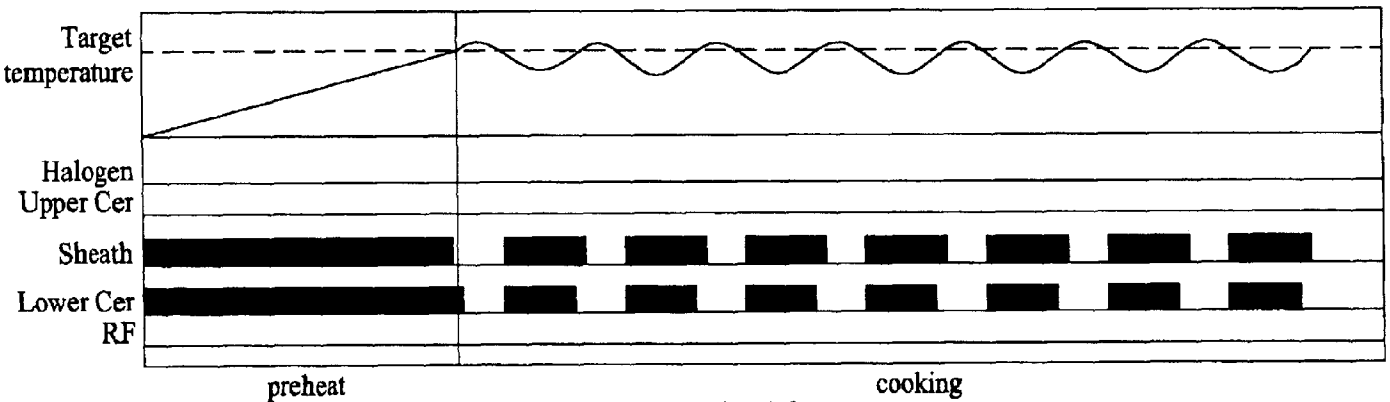
FIG. 30 illustrates duty cycles for the oven/bake mode illustrated in FIG. 29.

FIG. 29 is a block diagram illustration of an oven/bake mode, and FIG. 30 illustrates duty cycles for the oven/bake mode. During the oven/bake mode, sheath heater 140 and lower ceramic heater 144 are energized. Specifically, during the pre-heat cycle, both the sheath heater and the lower ceramic heater are energized. Once the oven cavity temperature reaches the pre-heat temperature, then control 118 causes the sheath heater and the lower ceramic heater to be energized in accordance with a predetermined control.

Although many alternatives are possible, in one specific embodiment, the general control objective is to prevent the lower portion of the food from cooking at a faster rate than other portions of the food. Specifically, the lower ceramic heater is closer to the food than the sheath heater and therefore, unless a control is employed, the lower ceramic heater may cause the lower portion of the food to cook faster than other portions of the food.

Many control approaches can be used to achieve the desired result, i.e., even cooking of the food. In an exemplary embodiment, the lower ceramic heater is energized to be on for a shorter period of time than the sheath heater. For example, the lower ceramic heater can be controlled to be on for about 63% of the time that the sheath heater is on. Such control of the ceramic heater and the sheath heater facilitates maintaining the oven cavity temperature near a target temperature without over-shoot and under-shoot that may result in over or under cooking foods.

Rather than controlling the lower ceramic heater as described above, the lower ceramic heater could be controlled to operate to output a lower wattage than normal operation. For example, if the lower ceramic heater normally operates at 375 watts, the lower ceramic heater could be controlled to output 275 watts. As yet another alternative, the lower ceramic heater can be energized on every other ½ cycle, i.e., cycle skipping, to reduce the energy supplied to such heater and consequently, the energy output by the heater. Again, many alternatives are possible.

During operation, an operator may adjust the power level of the upper heater module, the lower heater module, and the microwave module. To change the power level, the operator selects the POWER LEVEL pad and a select icon flashes on display. A message "Select UPPER POWER" then is displayed. Rotation of dial then enables an operator to select the upper power level (clockwise rotation increases the power level and counter clockwise rotation decreases the power level). In the speedcook mode, selection of the upper power level inherently determines the microwave power level as well, since the duty cycle is defined such that the microwave runs whenever the upper heaters (ceramic and halogen) are off. When dial is pressed to enter the selection, a short beep sounds and "Select LOWER POWER" is displayed. Dial rotation then alters the current lower power level, and when dial is pressed, a short beep is sounded. "Press START" is then displayed. The oven will wait until the START pad is pressed before beginning cooking. If the power level pad is pressed when it is not allowed to change/enter or recall the power level, a beep signal (0.5 seconds at 1000 hz) sounds and the message "POWER LEVEL MAY NOT BE CHANGED AT THIS TIME" scrolls on display. After the scroll has completed, the previous foreground features return. If the power level pad is pressed at a time when a change/entry is allowed, but no dial rotation or entry occurs within 15 seconds, the display returns to the cooking countdown.

Cook time may also be adjusted during cooking operations. During cooking operations, a main cooking routine COOK is executed. If dial is not moved, the main cooking routine continues to be executed. If dial is moved, then the microcomputer determines whether dial was moved clockwise. If no (i.e., dial was moved counterclockwise), then for each increment that dial is moved, the cook time is decremented by one second. If yes, then for each increment that dial is moved, the cook time is incremented by one second.

Oven may also be operated in a warming mode. Specifically, if a user select "Warm", then the lower ceramic heater and the sheath heater are energized to a selected target temperature, e.g., a temperature in a range of about 140 to 220 degrees F. Such operation facilitates maintaining food warmth. In addition, it is contemplated that a moist/crisp selection could be provided for a user in the warming mode so that user can select whether the food to be warmed should be moist or crisp. Specifically, if a user selects moist, then damper is maintained closed to maintain moisture in the cavity whereas if the user selects crisp, the damper is opened to allow moisture to flow out of the cooking cavity.

While the invention has been described in terms of various specific embodiments, those skilled in the art will recognize that the invention can be practiced with modification within the spirit and scope of the claims.

What is claimed is:

1. An oven comprising:

a cooking cavity;

an RF generation module for delivering microwave energy into said cooking cavity;

an upper heater module comprising a halogen lamp, a ceramic heater, and a sheath heater configured to deliver radiant and thermal energy into said cooking cavity, and a convection fan positioned to direct air over each of said halogen lamp, said ceramic heater, and said sheath heater into said cooking cavity;

a lower heater module; and a control operatively connected to said RF generation module, said upper heater module, and said lower heater module for selective control thereof.

2. An oven in accordance with claim 1 wherein RF generation module comprises a magnetron.

3. An oven in accordance with claim 1 wherein said lower heater module comprises at least one of a halogen lamp, a ceramic heater and a sheath heater.

4. An oven in accordance with claim 1 wherein said control operates said oven in a plurality of modes, at least one of said modes comprising a microwave mode, a speedcook made, and a convection/bake mode.

5. An oven in accordance with claim 4 wherein in said microwave mode, said control is configured to energize said RF generation module.

6. An oven in accordance with claim 4 wherein in said speedcook mode, said control is configured to control the energization of said upper heater module, said lower heater module, and said RF generation module.

7. An oven in accordance with claim 6 wherein in said speedcook mode, at least said halogen lamp is selectively energized.

8. An oven in accordance with claim 4 wherein in said convection/bake mode, said control is configured to selectively energize said upper heater module and said lower heater module.

9. An oven in accordance with claim 8 wherein in said convection/bake mode, at least said sheath heater is selectively energized.

10. An oven in accordance with claim 1 wherein said control is configured to operate said oven in a warming mode.

11. An oven in accordance with claim 1 wherein operation of said RF generation module, said upper heater module, and said lower heater module are independently adjustable during operation of said oven.

12. An oven in accordance with claim 1 wherein said control panel is further adapted for user input and adjustment of a cooking time.

13. An oven in accordance with claim 1 wherein said control panel is coupled to a microcomputer, said microcomputer programmed to operate said RF generation module, said upper heater module, and said lower heater module for pre-selected target on times corresponding to a user selected operation mode.

14. An oven in accordance with claim 1 further comprising an air duct for airflow adjacent said cavity, a fan for generating air flow through said duct, a thermistor in flow communication with said duct, said thermistor coupled to said control, said thermistor configured to generate an output signal representative of cavity temperature, said control configured to generate a temperature value based on said thermistor output signal and farther configured to determine an adjustment to said temperature value based on whether said fan is energized.

15. An oven in accordance with claim 1 further comprising a thermistor in thermal communication with said cooking cavity, said thermistor coupled to said control, and wherein said control is programmed to determine whether said cavity is above a selected temperature upon initiation of a speedcooking cycle, and if said cavity is above said selected temperature upon initiation of the speedcooking cycle, then adjusting the energization of at least one of said upper heater module and said lower heater module.

16. An oven comprising:

a cooking cavity;

a plurality of modules for delivering energy into said cooking cavity, said energy comprising radiant energy, microwave energy, and thermal energy, said plurality of modules comprising an RF generation module, an upper module, and a lower module, wherein said RF generation module comprises a magnetron, wherein said upper module comprises a halogen lamp, a ceramic heater, and a sheath heater, and wherein said lower module comprises at least one of a ceramic heater and a sheath heater;

a convection fan positioned to direct air over at least one of said plurality of modules and into said cooking cavity; and a control operatively connected to said modules for controlling delivery of energy to said cooking cavity, said control configured to operate said modules in a microwave cooking mode, a convection/bake cooking mode, and a speedcook mode.

17. An oven in accordance with claim 16 wherein in said speedcook mode, said control is operative to selectively energize said upper module, said lower module, and said RF generation module.

18. An oven in accordance with claim 17 wherein said upper module comprises a halogen lamp, a ceramic heater, and a sheath heater, and when in said speedcook mode, at least said halogen lamp is selectively energized.

19. An oven in accordance with claim 16 wherein in said convection/bake mode, said control is operative to selectively energize said upper module and said lower module.

20. A method for operating an oven including a microcomputer, said method comprising the steps of:

providing an RF generation module comprising a magnetron, an upper module comprising a halogen lamp, a ceramic heater, and a sheath heater, and a lower module comprising at least one of a ceramic heater and a sheath heater;

obtaining at least one input from a user indicative of whether the oven is to operate in a microwave mode, a convection/bake mode, or a speedcooking mode;

energizing the RF generation module, said upper module, and said lower module in accordance with the user input.

21. A method in accordance with claim 20 wherein if the oven is to operate in the microwave mode, then the RF generation module is energized.

22. A method in accordance with claim 20 wherein if the oven is to operate in the convection/bake mode, then the upper module and the lower module are energized.

23. A method in accordance with claim 20 wherein if the oven is to operate in the speedcooking mode, then the RF generation module, the upper module, and the lower module are energized.

* * * * *